US008692639B2

(12) United States Patent
Baarman et al.

(10) Patent No.: US 8,692,639 B2
(45) Date of Patent: Apr. 8, 2014

(54) FLUX CONCENTRATOR AND METHOD OF MAKING A MAGNETIC FLUX CONCENTRATOR

(75) Inventors: David W. Baarman, Fennville, MI (US); Joshua K. Schwannecke, Grand Rapids, MI (US); Roy M. Taylor, Jr., Rockford, MI (US); Matthew J. Norconk, Grand Rapids, MI (US); William T. Stoner, Jr., Ada, MI (US); Kaitlyn J. Turner, Grand Rapids, MI (US); Thomas J. Berwald, Grand Haven, MI (US); Michael E. Miles, Grand Rapids, MI (US)

(73) Assignee: Access Business Group International LLC, Ada, MI (US)

( * ) Notice: Subject to any disclaimer, the term of this patent is extended or adjusted under 35 U.S.C. 154(b) by 31 days.

(21) Appl. No.: 12/868,052

(22) Filed: Aug. 25, 2010

(65) Prior Publication Data

US 2011/0050382 A1 Mar. 3, 2011

Related U.S. Application Data

(60) Provisional application No. 61/236,732, filed on Aug. 25, 2009, provisional application No. 61/267,187, filed on Dec. 7, 2009.

(51) Int. Cl.

| | |
|---|---|
| ***H01F 5/00*** | (2006.01) |
| ***H01F 21/00*** | (2006.01) |
| ***H01F 27/28*** | (2006.01) |
| ***H01F 27/24*** | (2006.01) |

(52) U.S. Cl.
USPC ..... 336/200; 336/110; 336/232; 336/233

(58) Field of Classification Search
USPC ..... 336/200, 110, 222, 232, 233; 307/7, 17, 307/104
See application file for complete search history.

(56) References Cited

U.S. PATENT DOCUMENTS

| | | | |
|---|---|---|---|
| 3,881,038 | A | 4/1975 | Bondley |
| 3,933,536 | A | 1/1976 | Doser et al. |

(Continued)

FOREIGN PATENT DOCUMENTS

| | | |
|---|---|---|
| EP | 0 044 592 | 7/1981 |
| EP | 0 274 034 | 11/1987 |

(Continued)

OTHER PUBLICATIONS

International Searching Authority, Invitation to Pay Additional Fees, International Application No. PCT/US2010/046611, International Filing Date Aug. 25, 2010.

(Continued)

*Primary Examiner* — Alexander Talpalatski
*Assistant Examiner* — Mangtin Lian
(74) *Attorney, Agent, or Firm* — Warner Norcross & Judd LLP

(57) ABSTRACT

A flux concentrator and method for manufacturing a flux concentrator is provided. The method can include combining powdered soft magnetic material, a binder, a solvent, a internal lubricant; mixing the materials to create a mixture, evaporating the solvent from the mixture, molding the mixture to form a flux concentrator, and curing the flux concentrator. The flux concentrator may be laminated and broken into multiple pieces, which makes the flux concentrator more flexible. Breaking the flux concentrator does not significantly affect the magnetic properties. Since the permeability of the binder is very similar to that of air, adding tiny air gaps between the fractions is not significantly different than adding more binder.

19 Claims, 19 Drawing Sheets

(56) References Cited

U.S. PATENT DOCUMENTS

| | | | | |
|---|---|---|---|---|
| 3,968,465 | A | 7/1976 | Fukui et al. | |
| 4,009,460 | A | 2/1977 | Fukui et al. | |
| 4,184,972 | A | 1/1980 | Pevzner et al. | |
| 4,431,979 | A | 2/1984 | Stijntjes et al. | |
| 4,723,188 | A | 2/1988 | McMurray | |
| 4,810,572 | A | 3/1989 | Ooe et al. | |
| 4,921,553 | A | 5/1990 | Tokunga et al. | |
| 4,952,239 | A | 8/1990 | Tokunaga et al. | |
| 4,983,231 | A | 1/1991 | Yamanaka et al. | |
| 4,983,232 | A | 1/1991 | Endoh et al. | |
| 5,032,469 | A | 7/1991 | Merz et al. | |
| 5,059,387 | A | 10/1991 | Brasel | |
| 5,096,509 | A | 3/1992 | Endoh et al. | |
| 5,126,075 | A | 6/1992 | Nakagawa | |
| 5,200,720 | A | 4/1993 | Yi | |
| 5,240,627 | A | 8/1993 | Mohri et al. | |
| 5,252,255 | A | 10/1993 | Moy et al. | |
| 5,256,326 | A | 10/1993 | Kawato et al. | |
| 5,300,156 | A | 4/1994 | Mohri et al. | |
| 5,396,101 | A * | 3/1995 | Shiga | 257/531 |
| 5,418,069 | A | 5/1995 | Learman | |
| 5,464,670 | A | 11/1995 | Ikuma et al. | |
| 5,477,122 | A | 12/1995 | Hall et al. | |
| 5,478,409 | A | 12/1995 | Takahashi | |
| 5,529,747 | A | 6/1996 | Learman | |
| 5,643,491 | A | 7/1997 | Honkura et al. | |
| 5,647,886 | A | 7/1997 | Kitazawa et al. | |
| 5,694,030 | A * | 12/1997 | Sato et al. | 323/282 |
| 5,705,970 | A | 1/1998 | Nishida et al. | |
| 5,733,580 | A | 3/1998 | Ikuma et al. | |
| 5,821,638 | A | 10/1998 | Boys et al. | |
| 5,914,644 | A | 6/1999 | Carter et al. | |
| 6,036,815 | A | 3/2000 | Peterson et al. | |
| 6,037,052 | A | 3/2000 | Chen et al. | |
| 6,093,232 | A | 7/2000 | Sheinberg | |
| 6,139,765 | A | 10/2000 | Kitazawa et al. | |
| 6,204,744 | B1 | 3/2001 | Shafer et al. | |
| 6,365,078 | B1 | 4/2002 | Yamashita et al. | |
| 6,389,318 | B1 | 5/2002 | Zarinetchi et al. | |
| 6,460,244 | B1 | 10/2002 | Shafer et al. | |
| RE38,021 | E | 3/2003 | Endoh et al. | |
| RE38,042 | E | 3/2003 | Endoh et al. | |
| 6,527,875 | B2 | 3/2003 | Arai et al. | |
| 6,537,463 | B2 | 3/2003 | Iwasaki et al. | |
| 6,551,418 | B2 | 4/2003 | Arai et al. | |
| 6,602,569 | B2 | 8/2003 | Yamashita et al. | |
| 6,611,035 | B2 | 8/2003 | Inoue | |
| 6,641,919 | B1 | 11/2003 | Hayashi et al. | |
| 6,713,735 | B2 * | 3/2004 | Terano | 219/632 |
| 6,716,488 | B2 | 4/2004 | Fleming et al. | |
| 6,855,265 | B2 | 2/2005 | Arai et al. | |
| 6,859,994 | B2 | 3/2005 | Oshima et al. | |
| 6,863,839 | B2 | 3/2005 | Yoshizawa et al. | |
| 6,872,325 | B2 | 3/2005 | Bandyopadhyay et al. | |
| 6,885,270 | B2 | 4/2005 | Buswell | |
| 6,906,608 | B2 | 6/2005 | Fujiwara et al. | |
| 6,927,658 | B2 * | 8/2005 | Okamoto | 336/65 |
| 6,933,822 | B2 | 8/2005 | Haugs et al. | |
| 6,943,330 | B2 | 9/2005 | Ring | |
| 6,946,944 | B2 | 9/2005 | Shafer et al. | |
| 6,950,006 | B1 | 9/2005 | Shikama et al. | |
| 6,951,625 | B2 | 10/2005 | Arai et al. | |
| 7,153,796 | B2 | 12/2006 | Jubb et al. | |
| 7,160,636 | B2 | 1/2007 | Kondo et al. | |
| 7,208,044 | B2 | 4/2007 | Zurbuchen | |
| 7,221,249 | B2 | 5/2007 | Shafer et al. | |
| 7,259,118 | B2 | 8/2007 | Jubb et al. | |
| 7,263,761 | B1 | 9/2007 | Shafer et al. | |
| 7,345,562 | B2 | 3/2008 | Shafer et al. | |
| 7,348,093 | B2 | 3/2008 | Danzer et al. | |
| 7,364,628 | B2 | 4/2008 | Kakimoto et al. | |
| 7,390,424 | B2 | 6/2008 | Senda et al. | |
| 7,396,595 | B2 | 7/2008 | Shibuya et al. | |
| 7,694,407 | B2 | 4/2010 | Yagi et al. | |
| 7,889,040 | B2 | 2/2011 | Viitanen et al. | |
| 2002/0039061 | A1 | 4/2002 | Timashov | |
| 2002/0084880 | A1 * | 7/2002 | Barbera-Guilem et al. | 336/200 |
| 2003/0008182 | A1 * | 1/2003 | Saitoh et al. | 428/699 |
| 2005/0090299 | A1 | 4/2005 | Tsao et al. | |
| 2005/0142426 | A1 | 6/2005 | Danzer et al. | |
| 2006/0163525 | A1 | 7/2006 | Senda et al. | |
| 2006/0290460 | A1 * | 12/2006 | Waffenschmidt et al. | 336/223 |
| 2007/0085647 | A1 * | 4/2007 | Kawarai | 336/83 |
| 2007/0115085 | A1 | 5/2007 | Clemmons | |
| 2008/0061733 | A1 | 3/2008 | Toya | |
| 2008/0116847 | A1 * | 5/2008 | Loke et al. | 320/108 |
| 2008/0157912 | A1 | 7/2008 | Tung et al. | |
| 2008/0164840 | A1 * | 7/2008 | Kato et al. | 320/108 |
| 2008/0213615 | A1 | 9/2008 | Kino et al. | |
| 2008/0237532 | A1 | 10/2008 | Moro et al. | |
| 2008/0303619 | A1 | 12/2008 | Viitanen et al. | |
| 2008/0303735 | A1 * | 12/2008 | Fujimoto et al. | 343/787 |
| 2009/0069485 | A1 | 3/2009 | Aoki | |
| 2009/0184791 | A1 | 7/2009 | Fukui | |
| 2010/0007215 | A1 * | 1/2010 | Sakuma | 307/104 |
| 2010/0015918 | A1 | 1/2010 | Liu et al. | |
| 2010/0181842 | A1 * | 7/2010 | Suzuki et al. | 307/104 |
| 2010/0194512 | A1 | 8/2010 | Pieteris | |
| 2010/0288418 | A1 | 11/2010 | Yang et al. | |
| 2010/0320843 | A1 * | 12/2010 | Kitamura et al. | 307/104 |
| 2011/0020662 | A1 | 1/2011 | Okamoto et al. | |
| 2011/0025133 | A1 * | 2/2011 | Sauerlaender et al. | 307/104 |
| 2011/0050382 | A1 | 3/2011 | Baarman et al. | |

FOREIGN PATENT DOCUMENTS

| | | |
|---|---|---|
| EP | 0 468 449 | 7/1991 |
| EP | 0 633 582 | 7/1994 |
| EP | 0 858 251 | 1/1998 |
| EP | 1 146 526 | 11/1999 |
| EP | 1 276 119 | 7/2002 |
| EP | 1422978 | 5/2004 |
| EP | 1947660 | 7/2008 |
| GB | 1480134 | 7/1977 |
| GP | 1480134 | 7/1977 |
| JP | 09-190938 | 7/1997 |
| JP | 2002-075615 | 3/2002 |
| JP | 2006-020766 | 1/2006 |
| WO | 97/34518 | 9/1997 |
| WO | 2004/099464 | 11/2004 |
| WO | 2005/036934 | 4/2005 |
| WO | WO2008/156025 A1 * | 12/2008 |
| WO | 2009116025 | 9/2009 |

OTHER PUBLICATIONS

Valery I. Rudnev, Inductoheat Group, An objective assessment of magnetic flux concentrators, Professor Induction, Heat Treating Progress, Nov./Dec. 2004, pp. 19-23.

Steward, A unit of Laird Technologies, part numbering system for ferrite disks and plates, located at http://www.lairdtech.com/Products/EMI-Solutions/Ferrite-Products/Ferrite-Disks---Plates/, retrieved on Aug. 28, 2008.

Home Made Plastic Apex Community Forum Posts by "Nerdz," dated Sep. 16, 2007 and Sep. 17, 2007, located at http://www.forumapex.com/anything_goes/114266-home_made_plastic.html.

Making Your Own Plastic Molded Objects, located at http://www.make-stuff.com/formulas_&_remedies/plastics/sulphpl.html, retrieved on Oct. 24, 2011, Wayback Machine indicates published by Jun. 19, 2010.

Croatian Welding Society, An Overview of the Development and Application of Advanced Materials, dated May 2001.

Cold Casting with Metals and Resins located at http://aldax.com.au, retrieved on Oct. 24, 2011, Wayback Machine indicates published by Aug. 16, 2010.

Aluminum Powder Metallurgy brochure located at www.aluminum.org, retrieved on Oct. 24, 2011, Wayback Machine indicates published by Jul. 12, 2010.

"Metal Cold Casting" located at http://www.sculpt.com/technotes/COLDCAST.html, retrieved on Oct. 24, 2011, Wayback Machine indicates published by Jul. 6, 2010.

(56) References Cited

OTHER PUBLICATIONS

Butler, et al, "Electromagnetic Penetration Through Apertures in Conducting Surfaces, IEEE Transactions of Electromagnetic Compatibility," vol. EMC-20, No. 1, dated Feb. 1978.

Po'Ad, et al, "Analytical and Experimental Study of the Shielding Effectiveness of a Metallic Enclosure with Off-Centered Apertures," White Paper from 17th International Zurich Symposium on Electromagnetic Compatibility held on Feb. 27 to Mar. 3, 2006.

Mamunya et al, "Electrical and Thermal Conductivity of Polymers Filled with Metal Powders," published in the European Polymer Journal No. 38, on Feb. 7, 2002.

* cited by examiner

FLUX CONCENTRATOR AND METHOD OF MAKING A MAGNETIC FLUX CONCENTRATOR

BACKGROUND OF THE INVENTION

The present invention generally relates to magnetic flux concentrators and methods of manufacturing magnetic flux concentrators.

Magnetic flux concentrators, sometimes referred to as flux guides, flux focusers, flux intensifiers, flux diverters, flux controllers, flux reflectors and other names, are generally known and have been used in inductive heating and inductive power transfer applications. Flux concentrators intensify the magnetic field in certain areas and can assist in increasing efficiency in power or heat transfer. Without a concentrator, the magnetic field is more likely to spread around and intersect with any electrically conductive surroundings. In some circumstances, a magnetic flux shield can be a type of magnetic flux concentrator.

Soft magnetic materials, that is materials that are magnetized when an external magnetic field is applied, are sometimes used in manufacturing flux concentrators. Soft magnetic materials have magnetic domains that are randomly arranged. The magnetic domains can be temporarily arranged by applying an external magnetic field.

One of the most common soft magnetic materials used in manufacturing flux concentrators is ferrite. Ferrite flux concentrators are dense structures typically made by mixing iron oxide with oxides or carbonates of one or more metals such as nickel, zinc, or manganese. The variety of "ferrites" is extremely diverse, because of the numerous combinations of metal oxides, including some that contain no iron. Typically, they are pressed, then sintered in a kiln at high temperature and machined to suit the coil geometry. Ferrites generally have very high magnetic permeability (typically over $\mu_r$=2000) and low saturation flux density (typically between 3000 to 4000 Gauss). The main drawbacks of ferrite flux concentrators are that they are often brittle and tend to warp when manufactured in thin cross sections. Ferrites also typically have a low saturation flux density and therefore become saturated easily and thus are no longer significantly more permeable to magnetic fields than air in the presence of other magnetic fields, which may be undesirable in some applications. Ferrite flux concentrators are sometimes made thicker to compensate for the brittleness and poor saturation flux density. Ferrite flux concentrators may be machined thinner, though the hardness can make it difficult. However, machining thin components will not resolve the saturation issues or volume manufacturability. Further, machining components can make mass production expensive and difficult.

Another soft magnetic material sometimes used in manufacturing flux concentrators is magnetodielectric materials (MDM). These materials are made from soft magnetic material and dielectric material, which serves as a binder and electric insulator of the particles. MDM flux concentrators come in two forms: formable and solid. Formable MDM is putty-like and is intended to be molded to fit the geometry of the coil. Solid MDM is produced by pressing a metal powder and a binder with subsequent thermal treatment. The characteristics of an MDM flux concentrator vary based on, among other things, binder percentage. Typically, the less binder the higher the permeability. However, in conventional arrangements, less binder translates to more metal on metal contact, and therefore more eddy currents forming during use of the flux concentrator. Although MDM flux concentrators may be manufactured with a thin profile, it is difficult to manufacture an MDM flux concentrator with all of the desired magnetic and thermal characteristics due to the competing effects of varying the binder percentage.

Consumer electronics, such as cell phones, mp3 players, and PDA's, are trending toward slimmer profiles. Simultaneously, there is increasing demand for portable devices to be capable of receiving wireless power. Current flux concentrators suitable for use with wireless charging systems are generally too thick and therefore can noticeably increase the profile of consumer devices. Accordingly, there is a desire for a method of manufacturing a thin flux concentrator that has the desired magnetic and thermal characteristics suitable for use with a wireless power transfer system.

SUMMARY OF THE INVENTION

The present invention provides flux concentrator and a method for manufacturing a flux concentrator. In one embodiment, the method includes the following steps: 1) combining a powdered soft magnetic material, a binder, a solvent, and one or more lubricants; 2) mixing at least the powdered soft magnetic material, the binder, and the solvent for a sufficient time to dissolve the binder in the solvent to create a mixture; 3) evaporating the solvent from the mixture; 4) molding the mixture to form a flux concentrator; and 5) curing the flux concentrator. Utilizing the appropriate types and amounts of materials the resultant magnetic flux concentrator can be manufactured with magnetic and thermal characteristics suitable for use with a wireless power transfer system. In addition, the resultant magnetic flux concentrator can be reliably manufactured with dimensions appropriate for a wireless power transfer system. For example, in one embodiment a magnetic flux concentrator can be manufactured with a saturation induction greater than or equal to about 500 mT and have a minimum width to thickness dimension ratio or a minimum height to thickness dimension ratio of about 25 to 1. These results are achievable, at least in part, due to particle or agglomeration sizes being kept within a particular range. In some embodiments, prior to molding, the mixture may be sieved to control the size of the particles or agglomerations to be molded. In one embodiment the powdered soft magnetic material is agglomerated and sieved to between about 75 and 430 microns. In an alternative embodiment, the powdered soft magnetic material particle size is naturally between about 75 and 430 microns, so no agglomerations need be formed and no sieving is necessary.

The method of manufacturing a flux concentrator may include adding an external lubricant and an internal lubricant. In embodiments including both external and internal lubricant, the external lubricant tends to bloom to the outside surface of the agglomerated mixture and lubricate the flow of the mixture as it fills the mold. The external lubricant may also help during the compression of the mixture. The internal lubricant tends to lubricate the individual soft magnetic particles, which reduces particle-to-particle contact as pressure is applied during the molding process, resulting in fewer eddy currents forming during use of the flux concentrator. The manufacturing process may be used to cost effectively mass produce flux concentrators that contain small amounts of binder and exhibit suitable magnetic and thermal characteristics. Further, a thin flux concentrator profile is readily achievable with this method. In alternative embodiments, a single lubricant may be utilized.

In one embodiment, the raw materials of the flux concentrator includes a range of 0.001-2.0 percentage of external lubricant by weight, a range of 0.005-3.0 percentage of internal lubricant by weight, a range of 0.5-3.0 percentage of binder by weight, and a balance of soft magnetic material. In embodiments where a solvent is used, the amount of solvent depends on the binder and the solvent selected. In the current embodiment, between 10-20 times as much solvent as binder is used. In one embodiment, during manufacture, a plurality of agglomerations made up lubricants, soft magnetic particles, and binder particles may be created. In embodiments where solvent is added, substantially all of the solvent can be evaporated during manufacture. The method of manufacture produces a mixture with agglomerations 700 microns and below. The mixture may be sieved to a narrower particle size range to help with uniformity of the material during the compaction process. In the current embodiment, the act of sieving separates the size of the agglomerations to between about 75 and 430 microns. In one embodiment, the flux concentrator has the following magnetic, thermal, and physical characteristics: permeability greater than 15 times the permeability of free space, saturation greater than 30 mT, conductivity less than 1 S/m, and thickness less than 1 mm. Such a flux concentrator may be manufactured using an embodiment of a method for manufacturing a flux concentrator of the present invention. In alternative embodiments, the flux concentrator may be manufactured to achieve different magnetic, thermal, and physical characteristics, depending on the application.

The flux concentrator may be laminated and broken into multiple pieces, which make the flux concentrator more flexible. Breaking the flux concentrator does not significantly affect the magnetic properties. Since the permeability of the binder is very similar to that of air, adding tiny air gaps between the fractions is not significantly different than adding more binder.

These and other features of the invention will be more fully understood and appreciated by reference to the description of the embodiments and the drawings.

DESCRIPTION OF EMBODIMENTS

Figure 1:
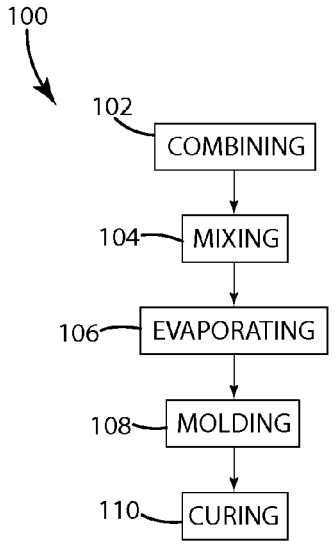
FIG. 1 is a flowchart illustrating one embodiment of a method of manufacturing a flux concentrator.

A flowchart for a method for manufacturing a flux concentrator in accordance with an embodiment of the present invention is illustrated in FIG. 1 and generally designated 100. The method 100 generally includes the steps of 1) combining 102 soft magnetic power, binder, solvent, lubricant (for example, external and/or internal lubricant); 2) mixing 104 at least the soft magnetic powder, binder, solvent, lubricant for a sufficient time to dissolve the binder in the solvent to create a mixture; 3) evaporating 106 the solvent, for example by heating and/or applying a vacuum to the mixture; 4) molding the mixture to form a flux concentrator; and 5) curing 110 the flux concentrator at a temperature sufficient to cure the binder. Although the materials are all combined, the combination need not take place just before the mixing or at the same time. For example, the lubricant(s) may be combined with the other materials anytime before the solvent is evaporated. In embodiments with more than one lubricant, some lubricant may be added before mixing and some after. In some embodiments, the particle size of the mixture may be controlled before pouring the mixture into the mold cavity, for example by sieving. Controlling the particle size of the mixture may include controlling the size of the agglomerations in the mixture.

The flux concentrator may be manufactured using essentially any soft magnetic material. In the current embodiment, iron powder is used because it has desirable magnetic characteristics in a frequency range used in connection with inductive power transfer systems. Two examples of suitable iron powder are Ancorsteel 1000C and carbonyl iron powder. Ancorsteel 1000C, and carbonyl iron powder both have relatively high permeability, relatively high saturation, and relatively low magnetic losses in the frequency range of 50 kHz to 500 kHz when insulated or used with a binder. Ancorsteel 1000C is available from Hoeganaes Corporation and carbonyl iron powder is available from BASF Corporation. The particle size of the soft magnetic material may vary depending on the application. In embodiments that utilize carbonyl iron powder, the carbonyl iron powder particles typically range from 0.5 to 500 microns. In embodiments that utilize Ancorsteel 1000C, the Ancorsteel 1000C particles typically range from 75 and 430 microns. Other types of iron powder or combinations of different types of iron powder may be used in different embodiments for cost reasons or to achieve certain desired properties of the flux concentrator.

In alternative embodiments, other soft magnetic materials may be used, such as soft magnetic alloys, insulated metal particles, or powdered ferrites. Specific examples of soft magnetic alloys that may be used include Moly Permalloy Powder, Permalloy, and Sendust. Use of soft magnetic alloys may enable use of a higher binder percentage without degrading the performance of the flux concentrator. An example of an insulated metal is phosphate coated iron. The insulation may reduce eddy currents and corrosion. It may be appropriate to modify the curing process to avoid inadvertently eliminating the insulation, which may be vulnerable to temperatures used during curing.

The particle distribution may be customized based on the particular application. In the current embodiment, a single type of soft magnetic material and binder is utilized, but in alternative embodiments, bimodal or other customized particle distributions may be utilized. For example, a combination of ferrite powder and carbonyl iron powder may be used to manufacture a flux concentrator with desired characteristics for a specific application. In alternative embodiments, blends of other powdered materials may be suitable, for example a combination of high permeability, soft magnetic powders.

The flux concentrator may be manufactured using essentially any binder capable of binding together the soft magnetic material to form a flux concentrator. A binder is a material used to bind together materials in a mixture. Examples of binders suitable for use in the present invention include thermoset polymers, thermoplastic polymers, silicone polymers, inorganic materials such as alumina, silica, or silicates, or any other binder capable of binding together the soft magnetic material to form a flux concentrator. Examples of thermoset polymers include epoxide (sometimes referred to as epoxy), Bakelite, and Formica. Epoxy is the binder used in the current embodiment. Epoxy is formed from reaction of an epoxide resin with a polyamine. The current embodiment uses a latent cure epoxy. It is a solid at room temperature, when the two monomers are combined, but do not cure to a crosslinked resin until heated. The resin and catalyst may be pre-combined or combined at the same time with the other materials before mixing, as in the current embodiment.

A solvent may be utilized as a carrier to disperse the binder within the soft magnetic powder. In the current embodiment, acetone is used as a solvent in order to dissolve the epoxy binder. In alternative embodiments, a different solvent may be utilized to disperse the binder. In the current embodiment, once the binder is dissolved in the solvent and mixed in the process, the solvent is evaporated.

Mixing a small percentage of binder with the powdered soft magnetic material can cause agglomerations to form in the mixture. Fine powders do not flow well and when poured into a mold cavity the fine particles tend to trap air. Relative to fine powders agglomerates can have better fill and flow characteristics. Depending on the makeup of the mixture, the size of agglomerations may be within a desired range, for example between from 75 and 430 microns. Depending on the makeup of the mixture, it can be beneficial to sieve the mixture to remove the smaller agglomerates and/or smaller particles and further improve fill and flow characteristics. For example, sieving may be utilized to achieve agglomeration sizes between 75 and 430 microns. In addition, certain agglomerates can provide certain magnetic, thermal, and mechanical properties to the resultant flux concentrator.

In embodiments that utilize external lubricants, the external lubricant can provide lubrication between the agglomerated particles, which allows the mixture to flow more quickly and fill the mold cavity with more uniformity. The external lubricant blooms to the outside surface of the agglomerations as the solvent evaporates and provides lubrication, thereby increasing the flow of the mixture and converting it into a free flowing powder.

The external lubricant can be selected to have limited compatibility with some or all of the soft magnetic material, binder, and solvent. In one embodiment, the external lubricant may be combined with the soft magnetic material, binder, and solvent before or during mixing. In alternative embodiments, the external lubricant may be added after mixing, but before the molding step. Polydimethylsiloxane may be used as an external lubricant and can be combined with the other materials before the mixing step. In alternative embodiments, a different external lubricant may be utilized, for example mineral oils or vegetable oils.

In embodiments that utilize internal lubricants the internal lubricant can reduce soft magnetic particle-to-particle conductivity in the finished flux concentrator and provide lubrication between the metal or ferrite particles during the molding operation. That is, the internal lubricant can reduce the eddy currents that form in the flux concentrator. Examples of suitable internal lubricants include metal soaps such as zinc stearate, and powdered waxes. The internal lubricant does not bloom to the outside of the agglomerations. Instead, the internal lubricant penetrates the agglomeration and gets in-between the soft magnetic powder particles, which decrease the opportunities for the particles to collide, which could result in additional electrical losses.

The lubricants used during the manufacturing process, both the internal and external, may enable less binder to be utilized while providing similar or improved magnetic and thermal characteristics.

The materials may be mixed in a conventional mixer and essentially any mixing technique may be utilized that mixes thoroughly enough and for a sufficient time to dissolve the binder in the solvent. Materials may be added in different orders and at different time throughout the mixing process.

A variety of evaporation techniques may be used in order to evaporate the solvent. In the current embodiment, the mixer includes a jacket where hot water or steam may be passed to heat the material in the mixer. The mixer of the current embodiment also includes a pump to obtain a vacuum within the mixer. As the solvent evaporates, the mixture dries into a powder, where there may be agglomerations of binder particles and soft magnetic material particles.

The powder may be directly poured into a cavity for molding or sieved to control the particle and/or agglomerate size. In one embodiment, powder is processed until a sufficient amount of solvent is evaporated such that the powder is dry and may be sieved. In an alternative embodiment, the sieving step is skipped and a less refined powder may be poured into the mold.

Figure 2:
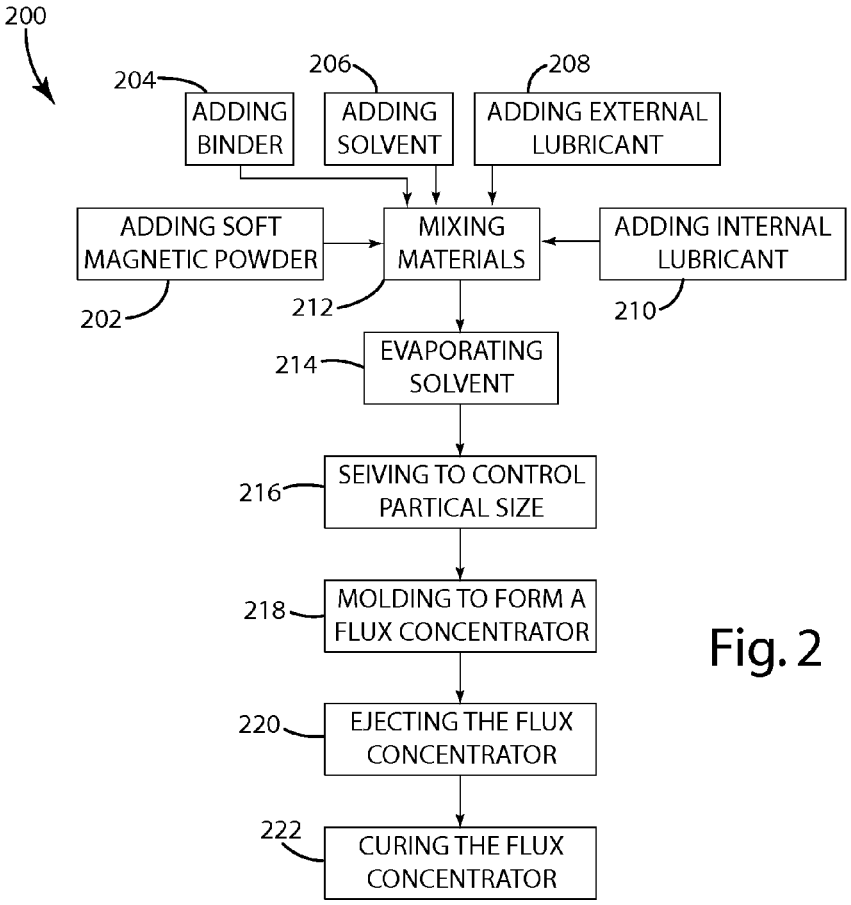
FIG. 2 is a flowchart illustrating another embodiment of a method of manufacturing a flux concentrator.

A flowchart of another embodiment of a method for manufacturing a flux concentrator is illustrated in FIG. 2, and generally designated 200. The method includes the steps of 1)

adding soft magnetic powder to a mixer 202; 2) adding binder to the mixer 204; 3) adding solvent to the mixer 206; 4) adding external lubricant to the mixer 208; 5) adding internal lubricant to the mixer 210; 6) mixing the materials until the solvent dissolves the binder 212; 7) evaporating the solvent 214; 8) sieving the mixture 216 to control particle size 216; 9) compression molding to form a flux concentrator 218; 10) ejecting the flux concentrator 220; and 11) curing the flux concentrator 222. One difference between this embodiment of the method for making a flux concentrator and the FIG. 1 embodiment is that the mixture is sieved to control the particle size. The sieving can be a one or two stage process that can remove particles that are too large and/or too small.

The mixture may be sieved to remove particles or agglomerates that are larger than a threshold, smaller than a threshold, or both. Narrow particle distributions will typically fill the mold more consistently and reliably. In one embodiment, the powder particles and agglomerates that are below a designated threshold are removed. Removal of fine particles leads to a better increased uniformity in filling the mold. Air can be trapped more easily by the smaller particles, so removing them from the mixture can be beneficial to the mold filling operation.

In one embodiment, if needed, large particles and agglomerates are removed with a 40 mesh US Standard Sieve (430 microns) and fine particles are removed with a 200 mesh US Standard Sieve (75 microns). Large agglomerates may be ground or crushed and added to the mixture and the smaller particles can be recycled back into future batches. In alternative embodiments, different size meshes or other sieving devices may be used to achieve different size particles in the mixture.

Figure 3:
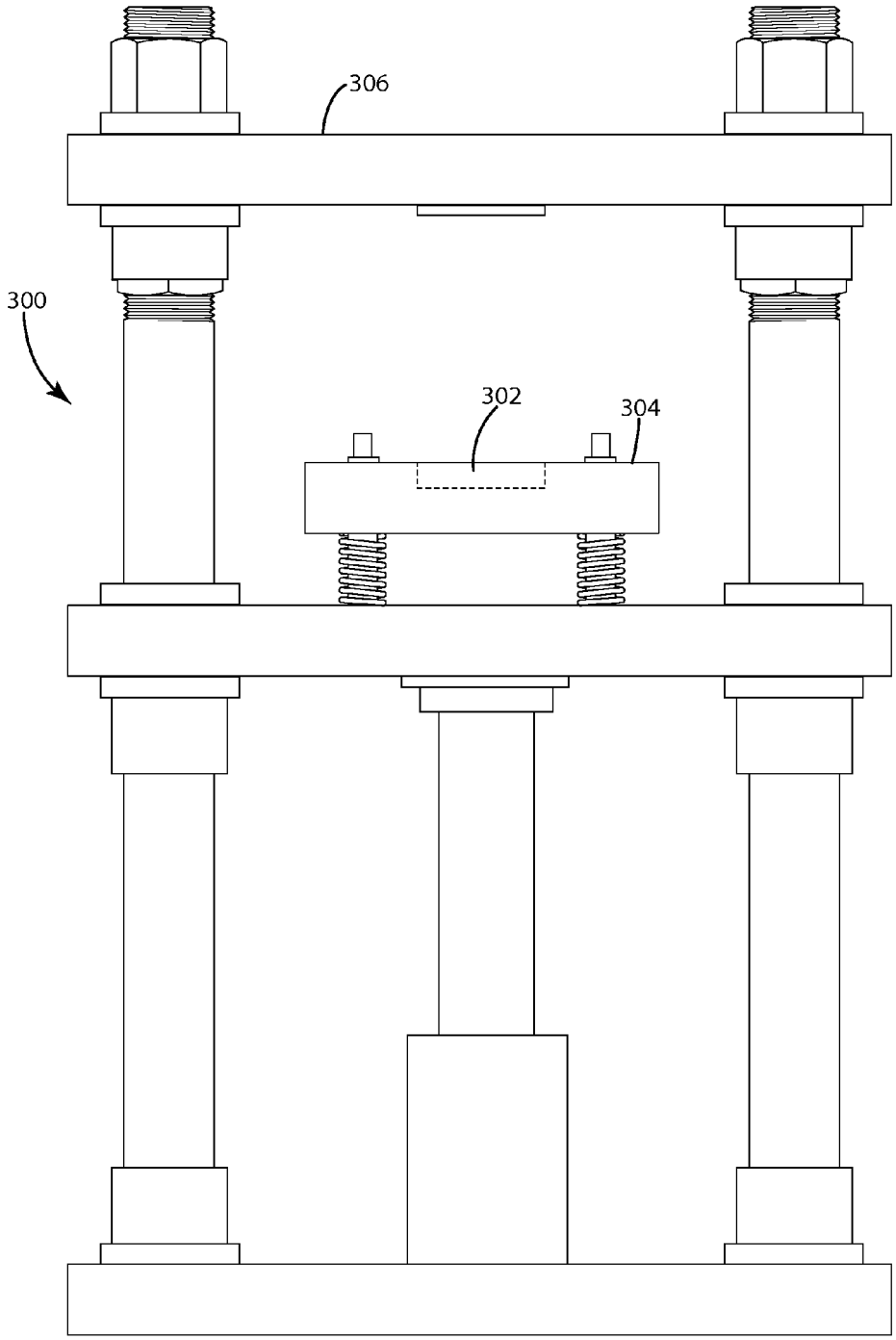
FIG. 3 is an illustration of an exemplary press used for compression molding a flux concentrator in accordance with an embodiment of the present invention.

A variety of different techniques may be used to mold the mixture to form the flux concentrator. In the current embodiment, the mixture is compression molded. An exemplary press 300 for compression molding is illustrated in FIG. 3. Simple or complex shapes may be molded through interchangeable molds, which can be used in conjunction with the mold cavity 302. The mixture, which in the current embodiment is in a powder form, is poured into the cavity 302 of the compression mold 304. In embodiments that utilize an external lubricant, the external lubricant assists in ensuring that the agglomerations flow and fill the compression mold. Generally, the powder is measured into the mold by volume, and filled by gravity. Typically, the press 300 is kept at room temperature, but in alternative embodiments, the mold may be heated. In performing the compression, the upper die 306 is brought down and presses the powder to form a solid part. In the current embodiment, the pressure may range from about 10 to 50 tons per square inch. In alternative embodiments, the pressure may be increased or decreased, depending on the application.

During the compression, pressure is applied to the agglomerations and the soft magnetic material particles within the agglomerations. In embodiments that utilize an internal lubricant, the internal lubricant helps the individual particles of soft magnetic material move as they are compressed. This can help produce parts of increased density and compressibility, decreased deformation and induced stress in the finished parts. The resultant flux concentrator can provide better performance characteristics than those produced using prior art techniques.

Although the current method is implemented using compression molding, alternatives to compression molding may be used. For example, extrusion techniques (such as ram extrusion), impact molding, or Ragan Technologies Inc. High-shear compaction are all examples of techniques that may be used instead of compression molding.

Once the compression molding is complete, the flux concentrator may be ejected from the mold. The flux concentrator may be cured or have other post treatment processes applied, before or after ejection. A number of post treatments may be appropriate to finalize the flux concentrator. In the current embodiment, temperature of about 350 degrees Fahrenheit is applied to the flux concentrator in order to cure the binder. In alternative embodiments, the part may be partially cured through a heated mold and then receive a final cure after ejection from the mold. There may be other post treatments, such as heat activation, low temperature curing, drying, moisture curing, UV curing, radiation curing, or resin impregnation. Resin impregnation is a process where the flux concentrator is dipped or coated with a binder resin dissolved in a solvent, if appropriate. The porous parts of the flux concentrator are they filled with the binder resin. The solvent is evaporated, leaving the resin to give additional strength to the flux concentrator. Depending on the binder resin, a heat process may be used to cure the binder. Resin impregnation may be useful to increase the strength of the flux concentrator or reduce the amount of metal corrosion that occurs over time.

Figure 4:
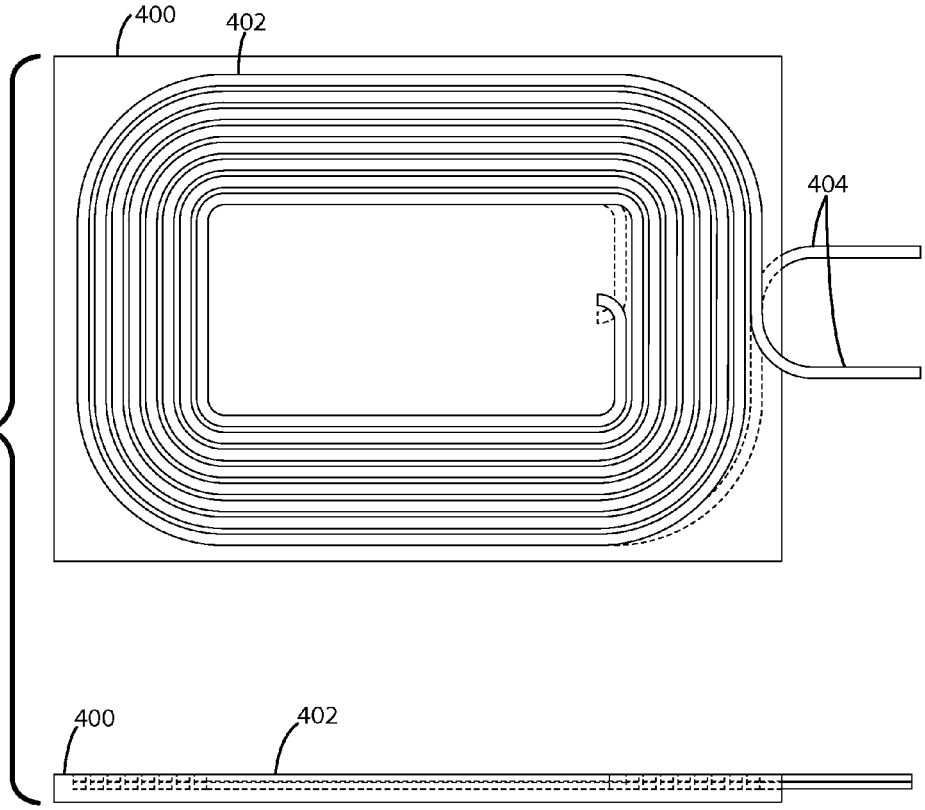
FIG. 4 is a top view and a side cross-sectional view of an embedded coil within one embodiment of a flux concentrator.

As shown in FIG. 4, a coil 402 may be embedded into the flux concentrator 400 during compression molding in order to reduce the z-height (as compared to a coil stacked on top of a flux concentrator) and increase the overall strength of the flux concentrator. To embed the coil flush with the surface, the coil can be placed in the bottom of the mold cavity then the soft magnetic material mixture can be placed in the cavity with the coil. After compression molding, the resultant flux concentrator includes an embedded coil that is exposed and flush with a surface of the flux concentrator. The embedded coil 402 is flush with the top surface of the flux concentrator, which allows inductive coupling to occur on that exposed side. That is, the coil is capable of being utilized as a primary or secondary coil in an inductive power transfer system where flux may transfer from or to the embedded coil on that side, depending if the coil is being used as a primary coil or a secondary coil. The thicker section of the flux concentrator is not intended for inductive coupling, but instead is intended to concentrate the field to increase the inductive coupling.

In the current embodiment, the embedded coil is a two layer stamped coil. A stamped coil is a coil that is sheared from a sheet of metal. A multi-layer stamped coil may be created by layering multiple stamped coils together with a dielectric in-between Vias or another type of connection can be utilized to connect the layers together. Although the stamped coil is two layers in the illustrated embodiment, in alternative embodiments the stamped coil may include additional or fewer layers. In alternative embodiments, the embedded coil may be a wire wound coil instead of a stamped coil and the coil may be a single layer or more than two layers.

Figure 18A:
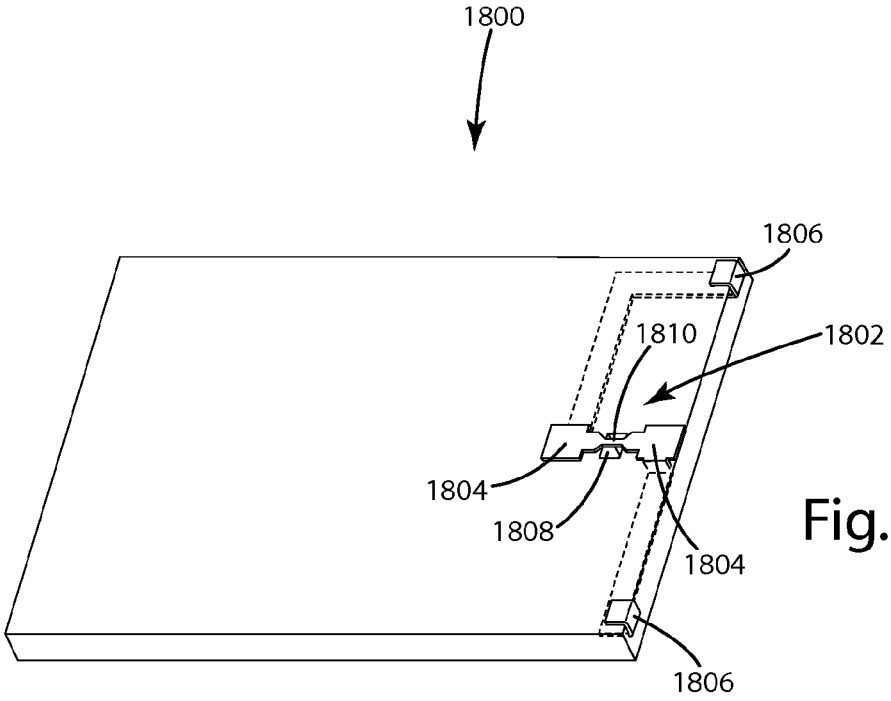
FIG. 18A shows a perspective view of a trace embedded in a compression molded magnetic flux concentrator.
Figure 18B:
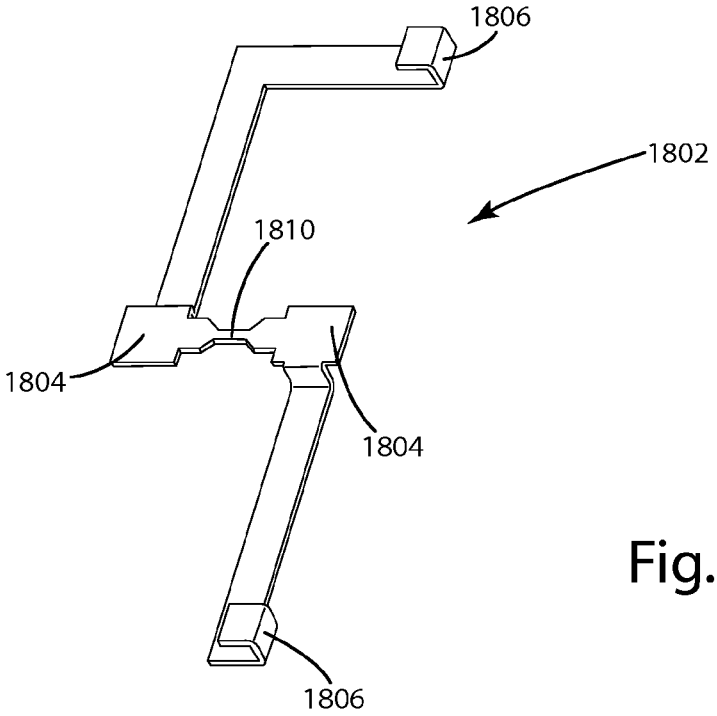
FIG. 18B shows a perspective view of the trace.
Figure 18C:
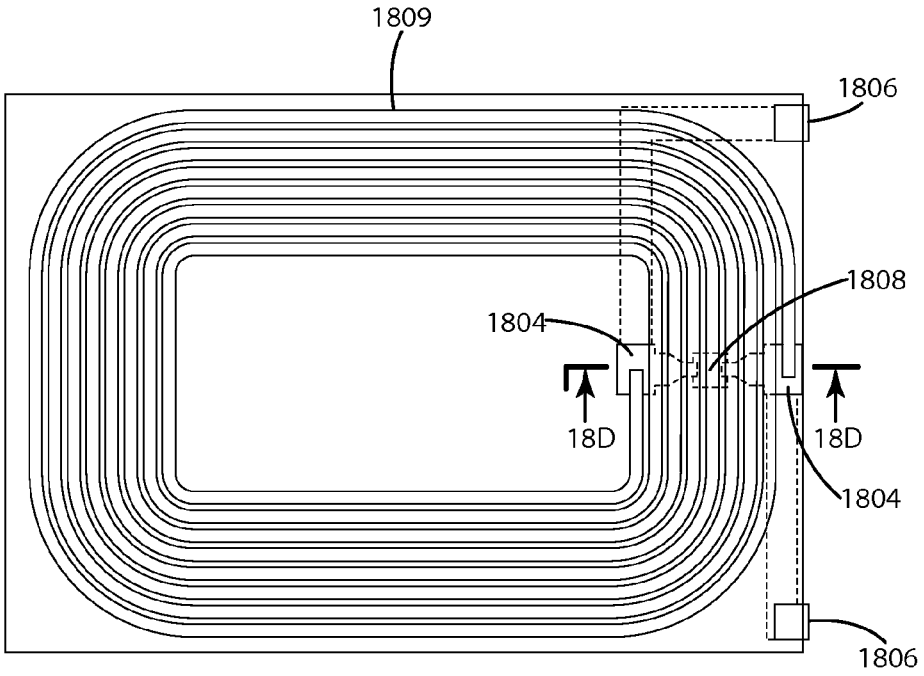
FIG. 18C shows a top view of a trace embedded in a compression molded magnetic flux concentrator connected to a stamped coil mounted on the surface of the compression molded magnetic flux concentrator.

As shown in FIG. 4, the coil leads 404 can protrude out of the compression molded flux concentrator. In alternative embodiments, the coil leads may be connected to stamped traces embedded within the compression molded flux concentrator. One exemplary configuration of stamped traces 1802 embedded within the compression molded flux concentrator 1800 is shown in FIGS. 18A-18D. FIGS. 18A-B show a perspective view of a compression molded flux concentrator 1800 including an embedded copper trace 1802. The trace includes pads 1804 for making a connection to a coil 1809, as shown in FIG. 18C.

Terminals 1806 may be stamped to conform to the edges of the flux concentrator. Connection to other circuit components may be touch-contact or soldered. The terminals might be straight to allow for Molex connectors. Also, straight terminal would facilitate direct soldering to a PCBA. Hole 1808, molded around/under the stamped copper facilitates the punching out of the traces. Punch-out location 1810 in copper stamping. After molding, this area is punched-out to break the circuit between the two traces.

Figure 18D:
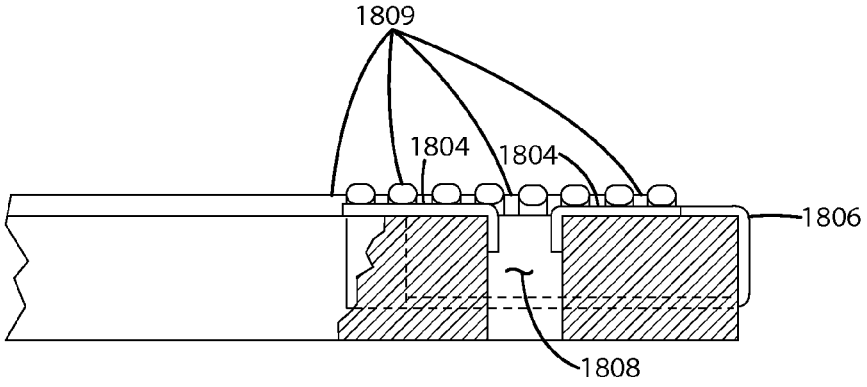
FIG. 18D shows a sectional view of FIG. 18C.

FIG. 18C provides a top view of the trace configuration embedded within a compression molded flux concentrator and connected to a surface mounted coil 1809. FIG. 18D illustrates the reduced stack height that is attainable by embedding the trace because there is no center wire that passes above or below coil. Instead, in the current embodiment, current is carried through the embedded copper traces. Of course, other metals besides copper may be used to carry the current in alternative embodiments.

The stamped copper traces embedded in compression molded flux concentrator can enhance the strength of the part, reduces overall assembly stack height because the trace required for the center wire is embedded in the magnetic flux concentrator, and enhance electrical connection of coil-flux concentrator assembly by allowing various termination types.

Figure 19:
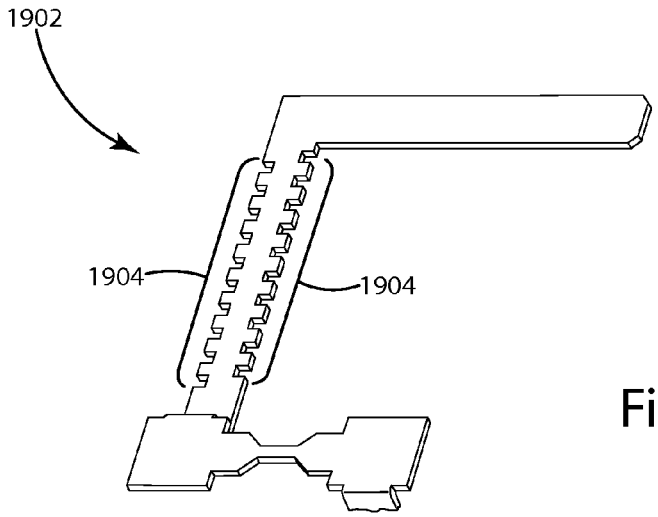
FIG. 19 shows a perspective view of an alternative embodiment of a trace.

FIG. 19 illustrates an alternative embodiment of a trace 1902 that can be embedded in a compression molded flux concentrator. A portion of the trace 1902 includes a serrated or castled edge 1904 that assists with anchoring the trace in the compression molded flux concentrator. Other anchoring geometry may be used in order to assist with anchoring the trace in the compression molded flux concentrator.

Figure 20:
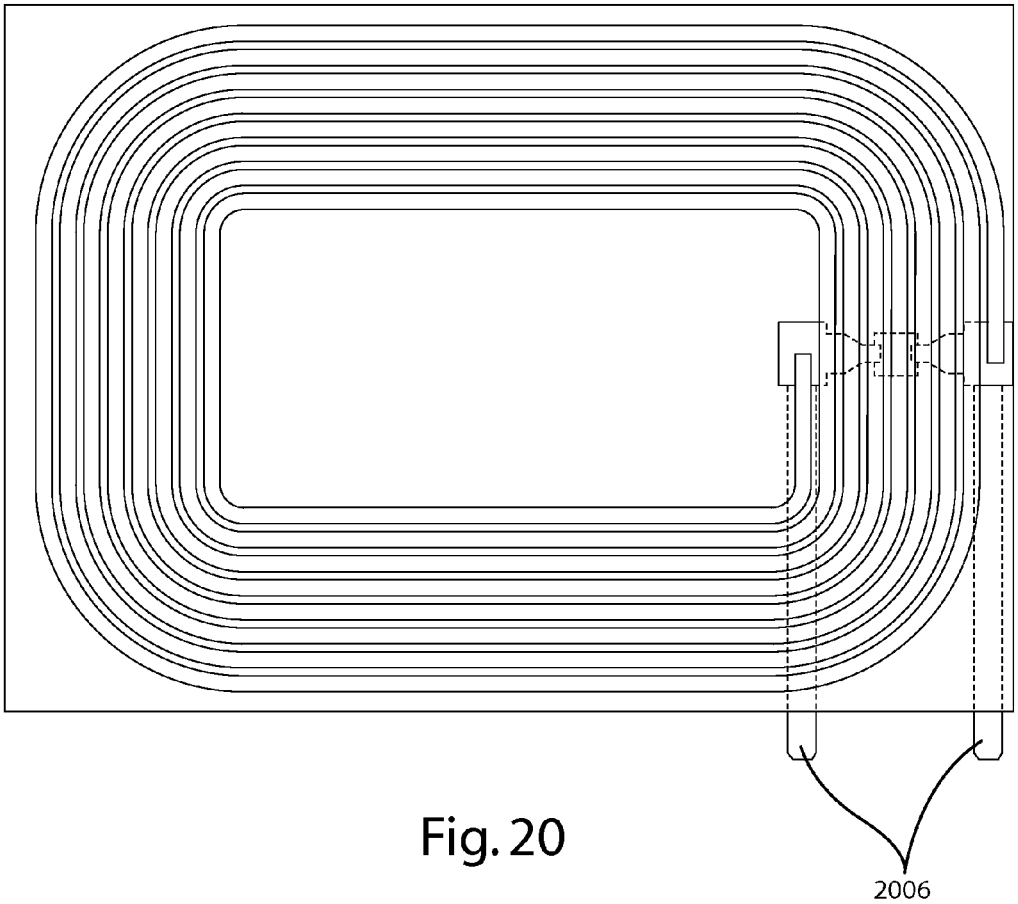
FIG. 20 shows an alternative embodiment of a trace embedded in a compression molded magnetic flux concentrator.

FIG. 20 illustrates an alternative embodiment that alters the location of the terminals 2006. The spacing between the terminals and their location may be adjusted to fit he application. For example, the terminals may be stamped to form spades for a Molex connector or direct soldering to a PCBA. Connection to other circuit components may be touch-contact or soldered. The terminals might also conform to the edges of the flux concentrator.

Figure 5:
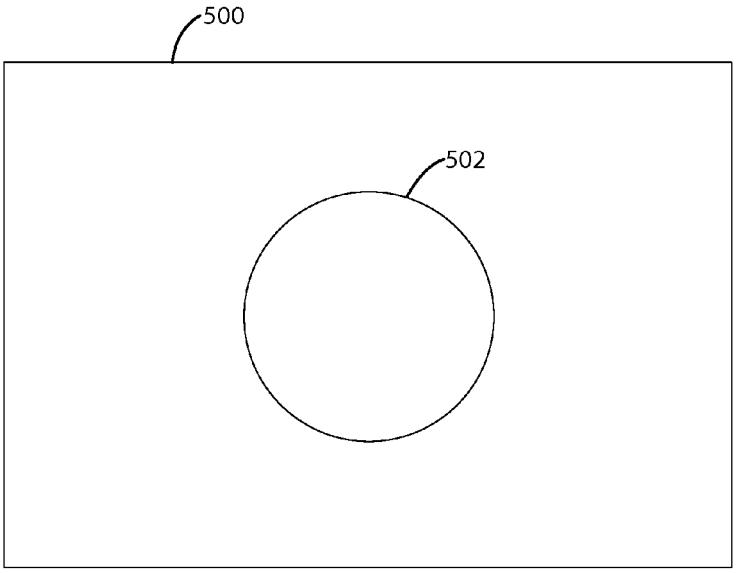
FIG. 5 is a top view of an embodiment of a flux concentrator including an embedded magnet.

As shown in FIG. 5, a magnet or magnetic attractor 502 may be co-molded, bonded or pressed in the flux concentrator 500 for strength and magnetic alignment. Alternatively, the permanent magnet or magnetic attractor insert may be inserted post process. Post process insertion may include friction fitting or gluing the permanent magnet or magnetic attractor in place. The materials for the flux concentrator may be selected for increased performance near a magnet or magnetic attractor. For example, a flux concentrator with a higher saturation may be suitable in an embodiment with a magnet, because a permanent magnet will locally decrease the saturation limit in the flux concentrator.

The permanent magnet or magnetic attractor may be configured so that it is exposed on the surface intended for magnetic attraction. Alternatively, the permanent magnet or magnetic attractor may be buried below the surface, but still capable of providing sufficient magnetic attraction for alignment of a remote device in a wireless power transfer system.

The permanent magnet or magnetic attractor may extend through the entire flux concentrator as illustrated in FIG. 5. Alternatively, the permanent magnet or magnetic attractor may extend partially external to the flux concentrator or through a portion of the flux concentrator, depending on the magnetic attraction force desired for a given application.

Figure 6:
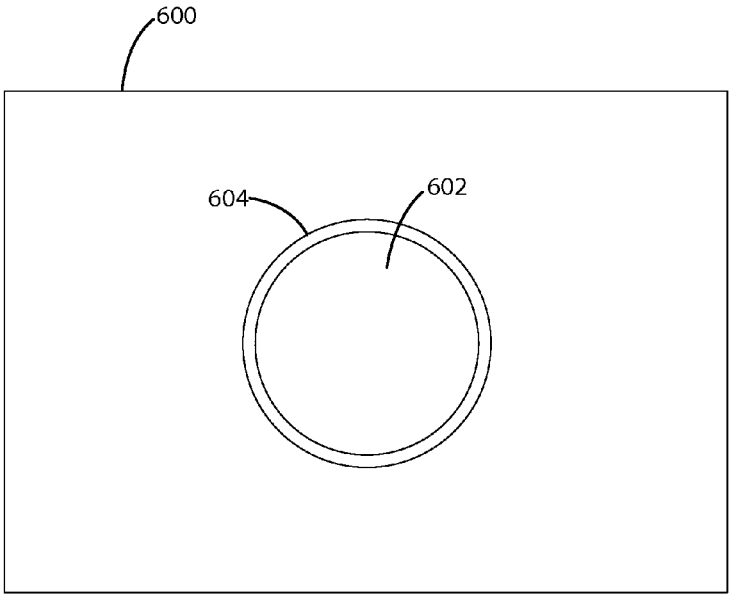
FIG. 6 is a top view of an embodiment with a magnet embedded within a flux concentrator and an insulator separating the magnet and the flux concentrator.

As shown in FIG. 6, the degraded saturation limit caused by a permanent magnet may be counteracted by an insulating portion 604 in the flux concentrator. In the illustrated embodiment, an air gap between the permanent magnet 602 and the flux concentrator 600 minimizes the effects of the DC field saturation typically caused by the permanent magnet. In alternative embodiments, an insulator other than air may be utilized. For example, the insulator could be a Mylar film or a flux guide wrap, such as an amorphous foil or a flux reflector.

Figure 7:
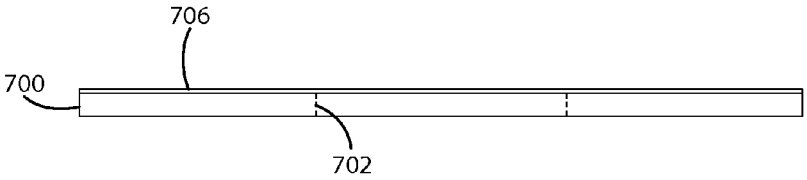
FIG. 7 is a side cross-sectional view of a laminated flux concentrator with an embedded magnet.

As shown in FIG. 7, a layer of strengthening material 706 may be laminated on the surface of the flux concentrator 700. The flux concentrator may be co-molded, extruded, or laminated for strength using a suitable material. For example, carbon fiber, glass fiber, graphene, plastic or Mylar film, amorphous magnetic material, Kevlar, or a different composite may be co-molded, extruded, or laminated on or with the flux concentrator. In another embodiment, small segments of steel wire are chopped up like small steel rebar like stabilizers but not so many as to create a substantially conductive matrix across the part. An optional permanent magnet or magnetic attractor 702, as described above, may be incorporated into laminated embodiments.

Figure 9:
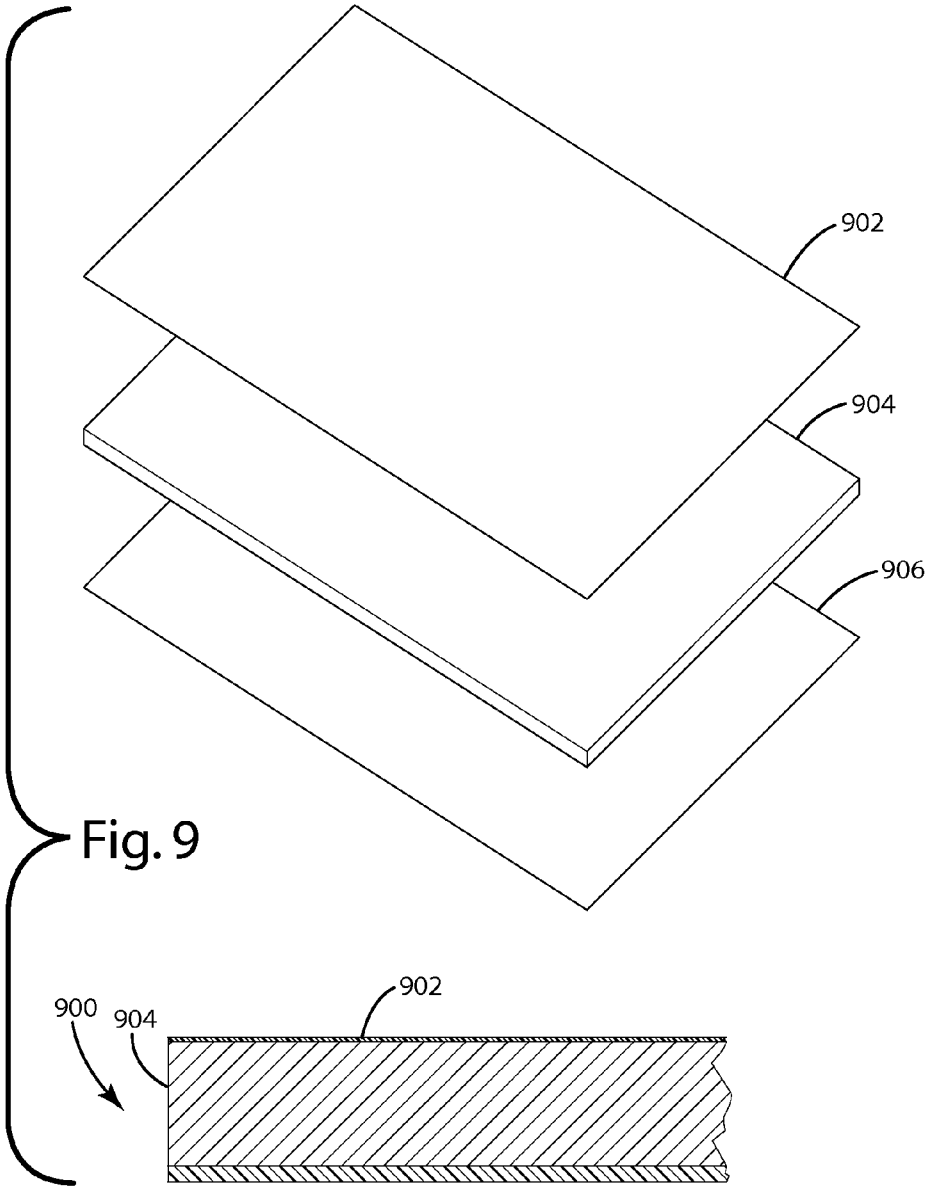
FIG. 9 is an exploded view and a side assembled view of a double laminated flux concentrator.

As shown in FIG. 9, material 902, 906 may be laminated on both surfaces of the flux concentrator 904 to form a flexible flux concentrator 900. In some embodiments the thickness of lamination may be the same on both sides of the flux concentrator, in other embodiments, such as the embodiment shown in FIG. 9, the laminations may have different thicknesses. The dimensions shown in FIG. 9 are merely exemplary. The lamination may include adhesive on one or both sides. For example, in FIG. 9, one layer of film is single-sided tape and the other layer of film is double-sided tape. The double-sided tape has one side that adheres to the flux concentrator and the other side that can be adhered to the surface to be shielded.

The laminated flux concentrator may be separated or broken into multiple pieces in order to form air gaps between different pieces of concentrator. The air gaps created by separating the flux concentrator into multiple pieces in conjunction with the lamination allows the flux concentrator to become more flexible. In addition, the additional air gaps in the flux concentrator do not significantly affect the properties of the flux concentrator. For example, in some embodiments there are already air gaps in the flux concentrator due to the polymeric materials included during its construction. Breaking the flux concentrator described above will generally increase the amount of air gaps, but not in a manner that significantly affects the properties of the flux concentrator relative to breaking up a prior art ferrite shield.

Figure 8:
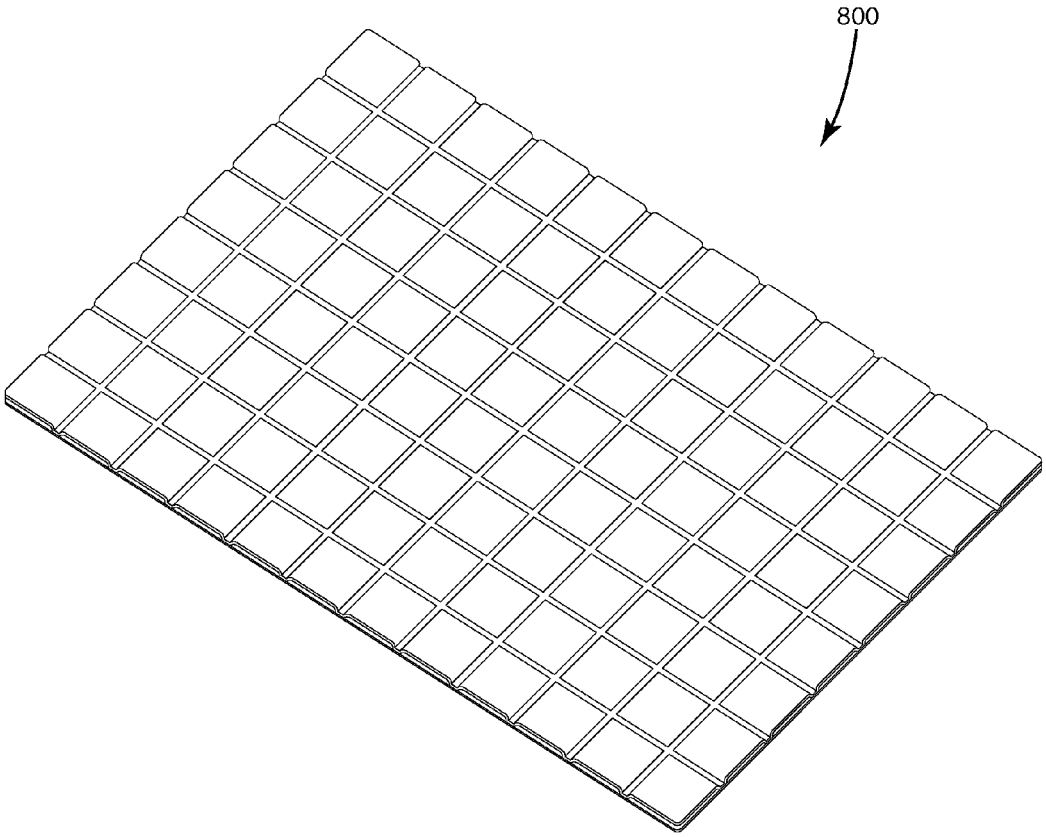
FIG. 8 is a perspective view of a laminated flexible flux concentrator.

The flux concentrator may be broken or separated into uniform or non-uniform pieces. In some embodiments, the flux concentrator is separated into generally uniform sized portions, such as the generally uniformly sized squares shown in the flux concentrator 800 of FIG. 8. In another embodiment, the flux concentrator may be separated into non-uniform pieces. For example, in FIG. 13 the flux concentrator is broken into random sized pieces and in FIG. 17 the flux concentrator is broken into an irregular pattern of different sized pieces.

There are a number of different techniques for breaking or separating the flux concentrator. Some of the possible techniques include 1) laminating and punching; 2) laminating and rolling; 3) scoring, laminating, and breaking; and 4) molding, laminating, and breaking.

Figure 10:
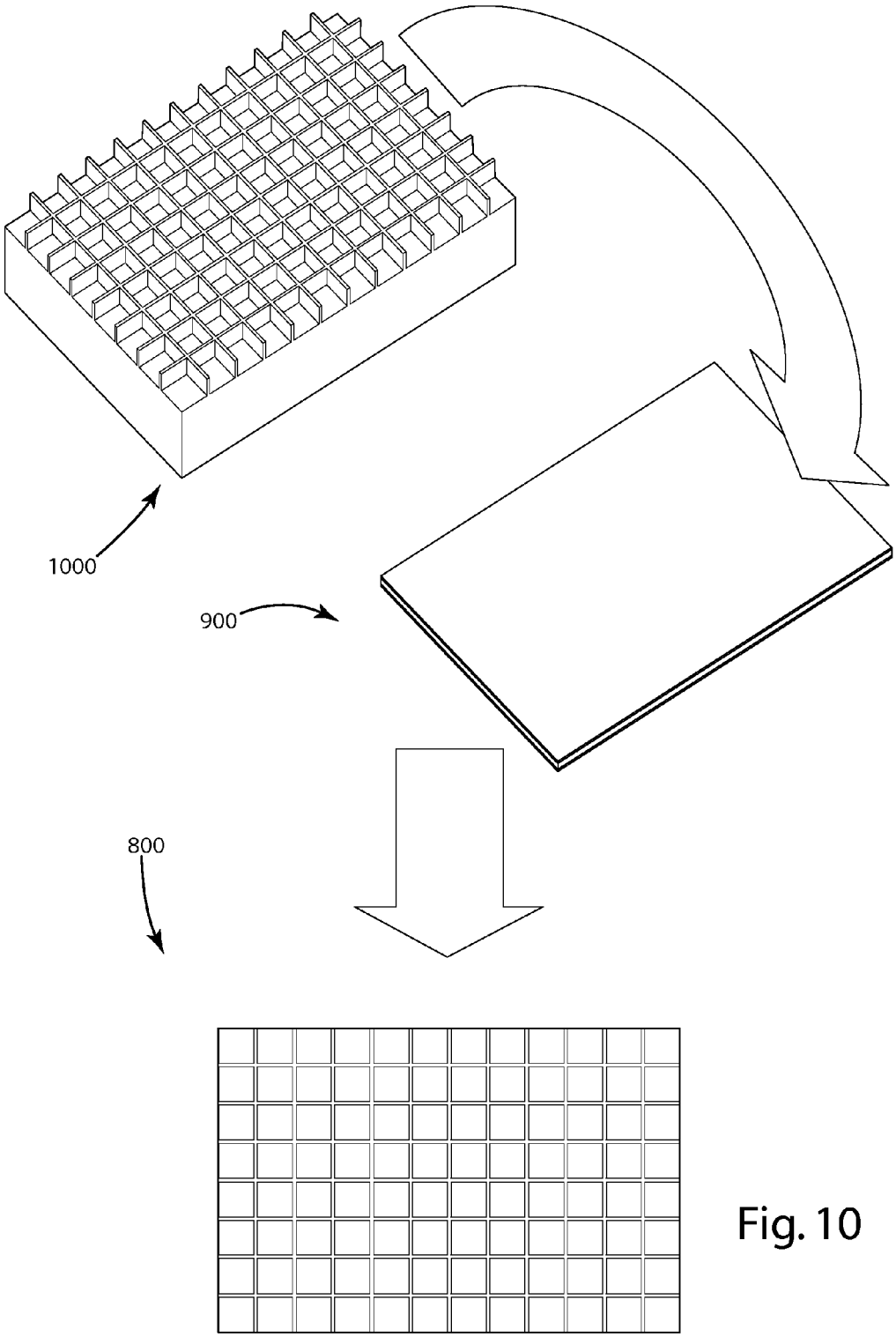
FIG. 10 is a representative view showing one method for creating a flexible flux concentrator.

Laminating and punching includes laminating the flux concentrator and then applying force onto a patterned die 1000 to punch the laminated flux concentrator 900 and break it into multiple pieces corresponding to the patterned die. Utilizing this technique, the flexible flux concentrator of FIG. 8 may be created. The die may include ridges that form a regular repeating geometric pattern, such as squares, triangles, hexagons, etc. In one embodiment, the ridges form a waffle pattern, as shown in FIG. 10. In alternative embodiments, the die may include irregular patterns or may instead include no pattern or a random pattern.

Figure 11:
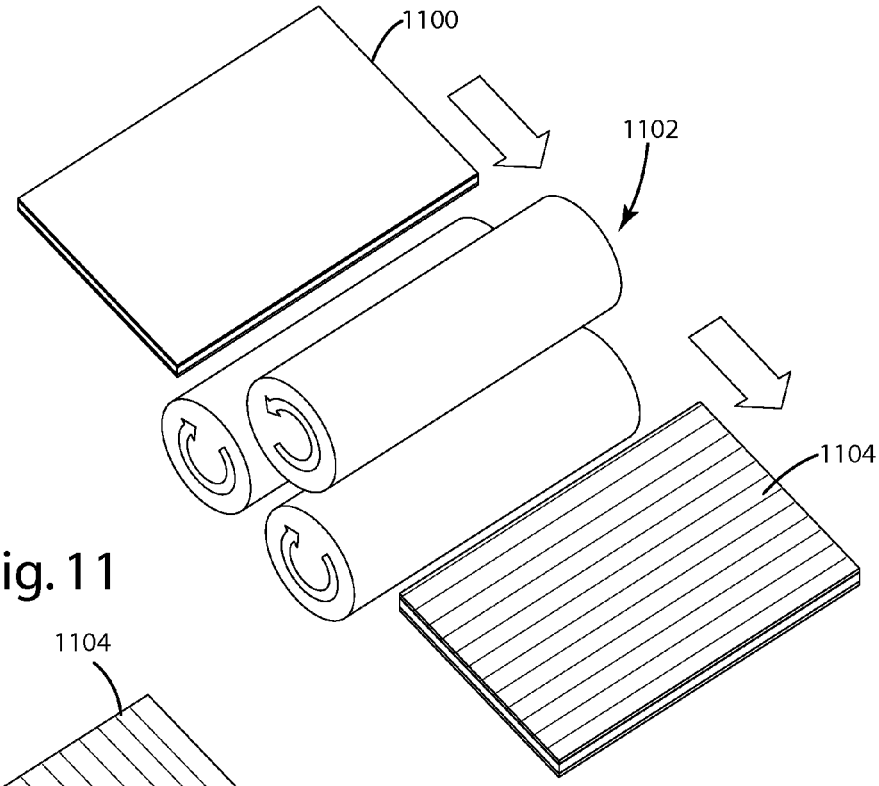
FIG. 11 is a representative view showing a method for creating a flexible flux concentrator using a roller.
Figure 12:
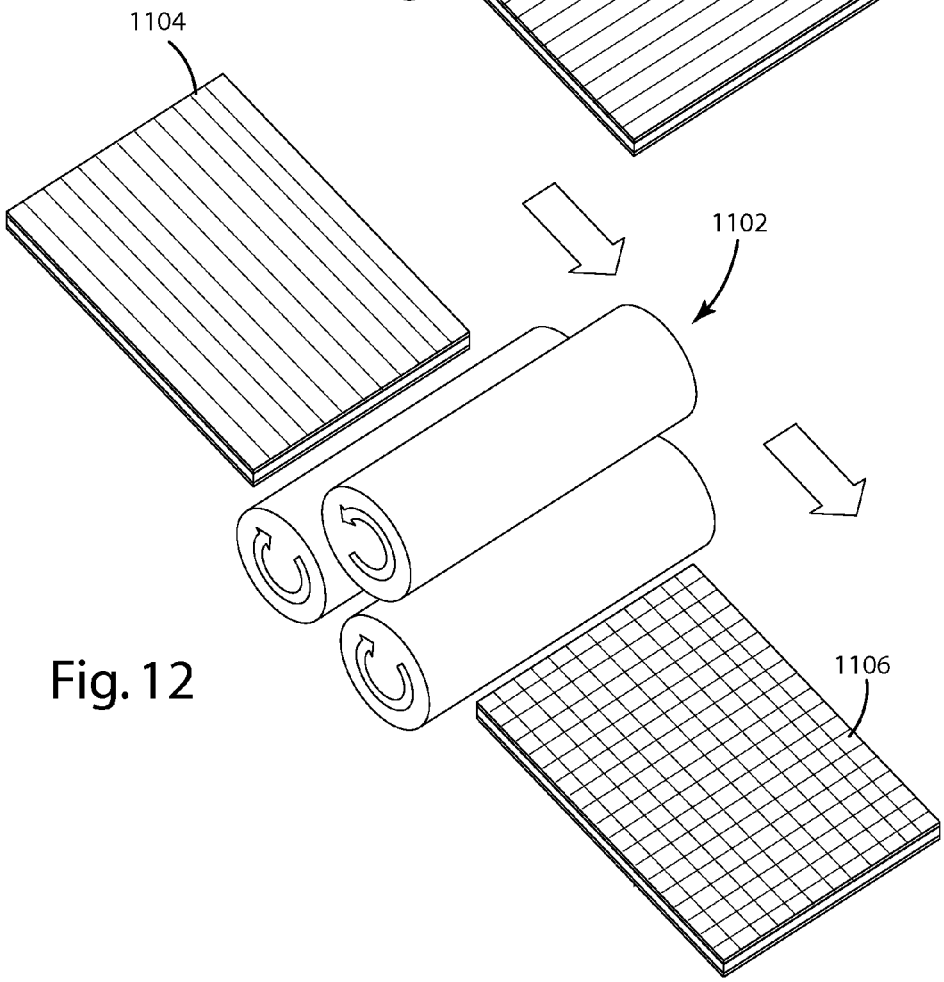
FIG. 12 is a representative view showing a method for creating a flexible flux concentrator using a roller.
Figure 13:
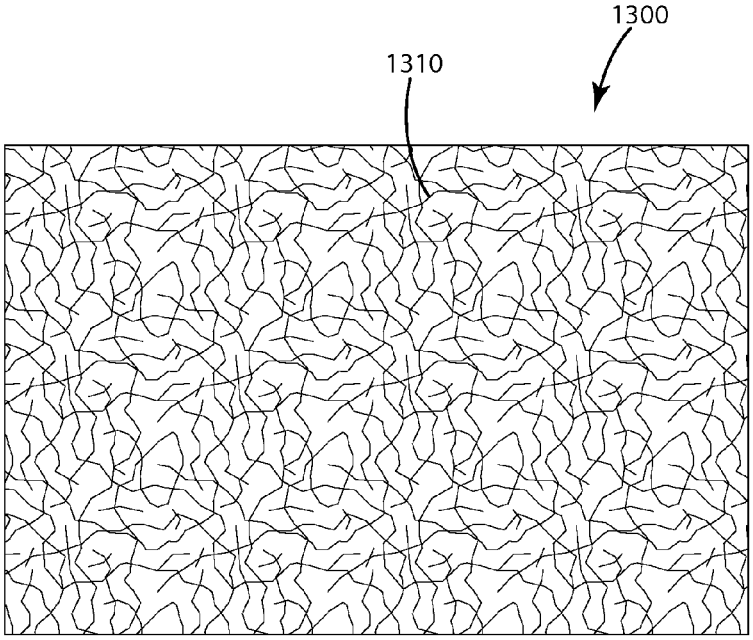
FIG. 13 illustrates two representative views showing break-points for two different flux concentrators.

Laminating and rolling includes laminating the flux concentrator and running the flux concentrator 11000 through a roller system 1102 to break the flux concentrator into multiple pieces. As shown in FIG. 11, a first pass through the roller 1102 breaks the flux concentrator 1100 in the direction generally parallel to the axis of the roller, resulting in a flux concentrator with fractures generally parallel to the axis of the roller 1104. In the current embodiment, the flux concentrator 1104 is rotated ninety degrees from the axis of the first pass through the roller and then run through the roller 1102 a second time. The breaks imparted in the magnetic flux concentrator on the second pass are predominantly in the direction parallel to the axis of the rollers, resulting in flux concentrator 1106. The breaks or fractures shown in FIGS. 11 and 12 are merely representative and in practice may not be perfectly parallel to the axis of the rollers. Further, the break or fracture lines actually occur in the flux concentrator itself, the lines drawn on the lamination are representative of the breaks that would occur in the flux concentrator. Depending on the roller system, the size and shape of the breaks may vary. If a smooth roller system is used, the flux concentrator 1300 may have breaks 1310 that are random, as shown in FIG. 13. The sizes of the chunks will depend at least on the amount of pressure, the radius of the roller, the spacing of the rollers, and the speed at which the flux concentrator is passed through the rollers. If the roller has a raised pattern on its surface, then a regular geometric pattern may be imparted to the magnetic flux concentrator during the rolling process, for example producing a flux concentrator like the one illustrated in FIG. 8. The size and shape of the geometric pattern may be selected based on the particular application.

Figure 14:
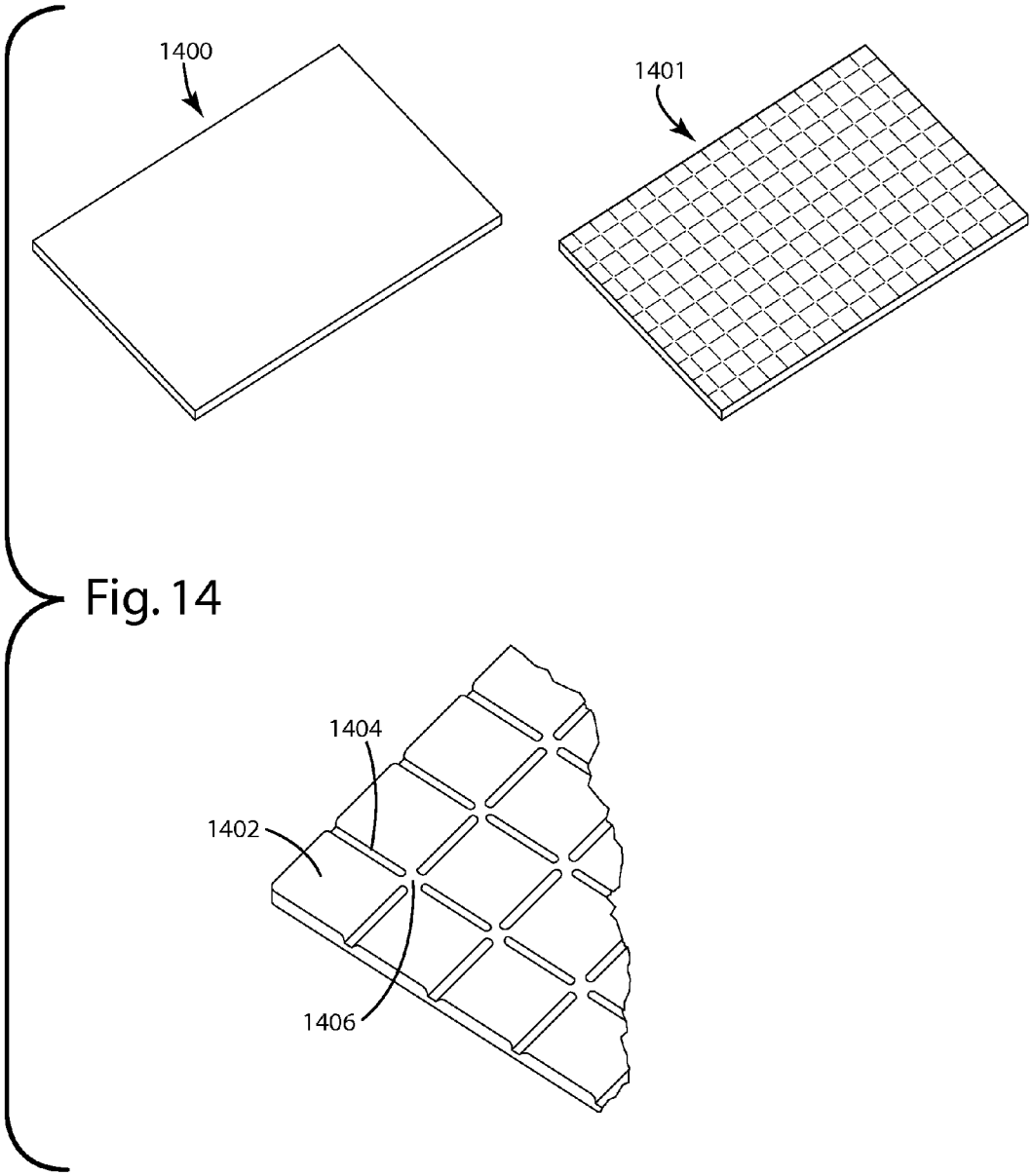
FIGS. 14 and 15 are representative views showing a method for creating a flexible flux concentrator by scoring and laminating.
Figure 15:
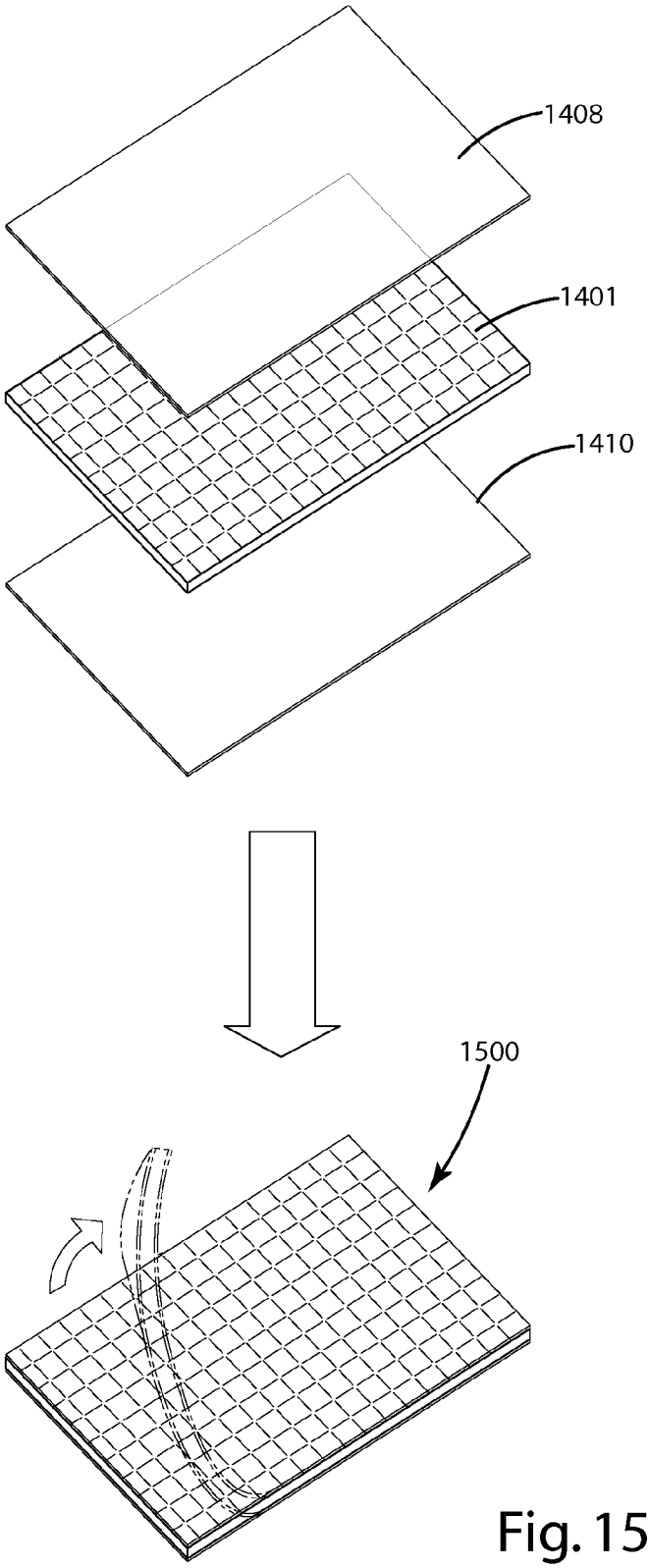

A method of scoring, laminating, and breaking is illustrated in FIGS. 14 and 15. The method includes first scoring the flux concentrator before it is laminated, laminating the flux concentrator, and then breaking the flux concentrator into multiple pieces. One method of scoring, laminating, and breaking the flux concentrator 1400 is shown in FIGS. 14 and 15 where the scored flux concentrator includes scores 1404 that define squares 1402. The scores may include break points 1406 where they cross. In alternative embodiment, the entire surface of the flux concentrator may be scored, without leaving any break points. Further, in the current embodiment one side of the flux concentrator is scored, but in an alternative embodiment the other side of the flux concentrator may be scored. In general, the scores are deep enough such that when the flux concentrator is broken the breaks tend to follow the scoring lines. Although the scores are shown in a generally square like pattern, the scores may be crafted in different patterns. In other embodiments, the scores may be replaced with perforation that cuts through the entire flux concentrator, but leaves sections of material connected. The lamination process does not vary from that described above with the other embodiments. In the current embodiment, the scored flux concentrator 1401 is laminated on one side with lamination 1408 and on the other side with a lamination 1410. Once laminated, the flexible flux concentrator 1500 is ready for use. During use, if the flux concentrator bends, it will tend to break along the score pattern, making it flexible. Alternatively, the flux concentrator may be broken into pieces along the score line by a user bending the flux concentrator.

Figure 16:
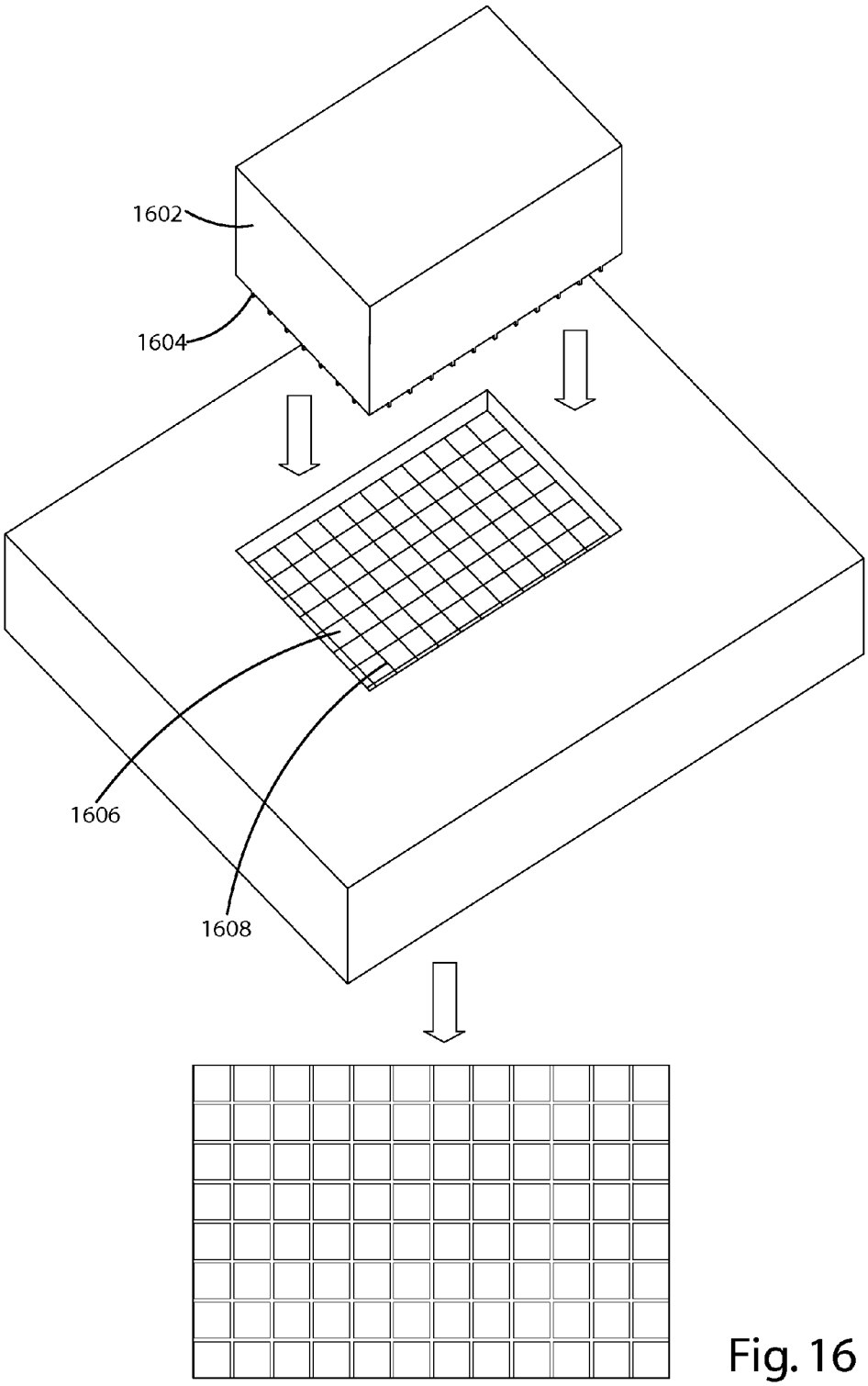
FIG. 16 is a representative view showing a method for creating a flexible flux concentrator by molding the concentrator with a pattern.

The flux concentrator may be molded with a pattern in order to facilitate breaking it into multiple pieces. A representative drawing of this technique is illustrated in FIG. 16. The mold press 1602 may include ridges 1604 in the mold that impart scores or trenches into the flux concentrator. The mold 1606 may also include ridges 1608 that impart scores or trenches into the flux concentrator as well. In some embodiments, such as the illustrated embodiment, the flux concentrator may be molded with score lines on both sides, in alternative embodiments, score lines may be molded on just one side, for example by deleting one of the ridges 1604 or ridges 1608. After the flux concentrator is molded, it may be laminated and broke into multiple pieces to make it flexible.

Figure 17:
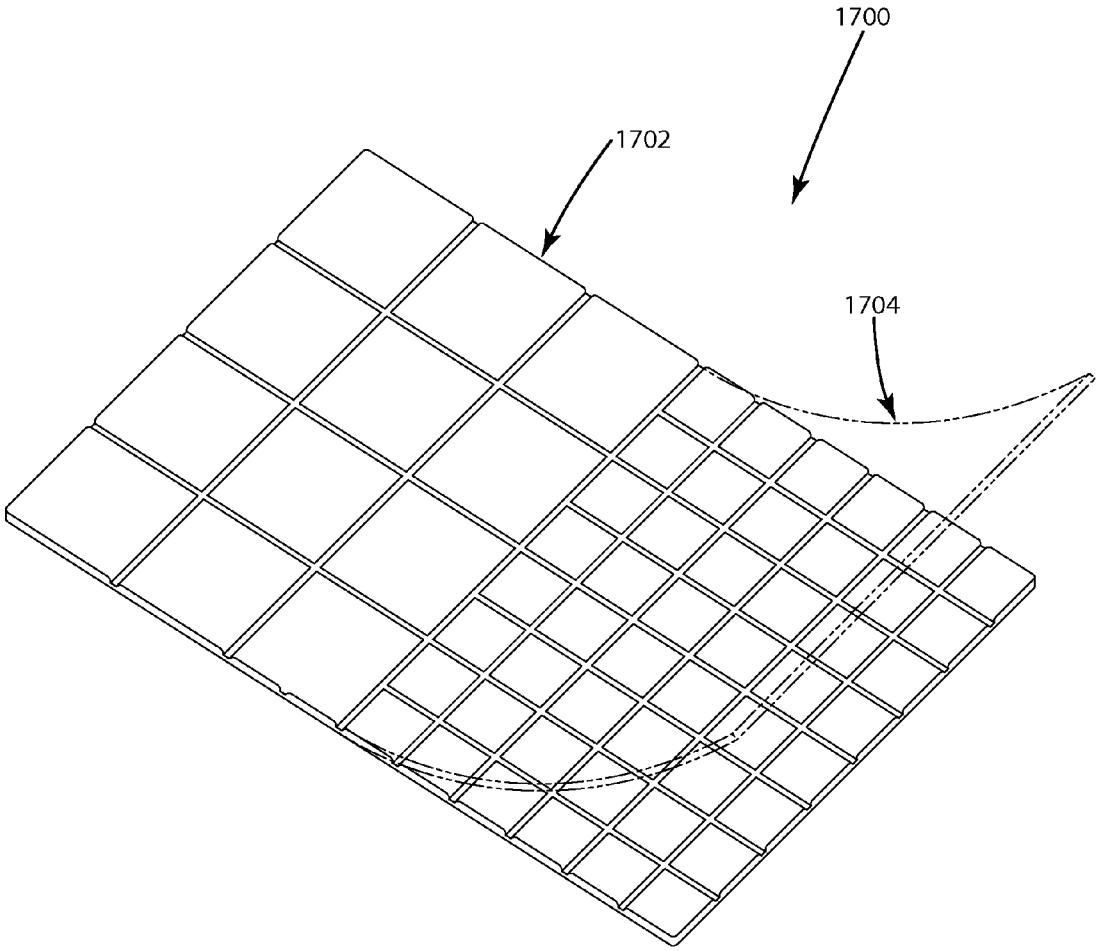
FIG. 17 shows a representative perspective view of a flux concentrator having an irregular pattern, allowing for various levels of flexibility in various zones of the flux concentrator.

In some embodiments, the breaks may be designed to allow the flux concentrator to be shaped in a particular manner. For example, in some embodiments, the chunks of flux concentrator may be sufficiently small that the flux concentrator can be flexed about a curved surface. In other embodiments, the flux concentrator may include different size or shaped pieces. For example, as shown in FIG. 17, by breaking a first section 1702 of the flux concentrator 1700 into pieces and breaking a second section 1704 of the flux concentrator 1700 into smaller sized pieces, the flux concentrator can be manufactured to accommodate specific geometries. Utilizing any of the above techniques, the flux concentrator can be made to conform to curves and other various shapes when it is adhered to an irregular surface to be shielded.

The above configurations may help enhance the desired magnetic, thermal, or mechanical properties of the magnetic flux concentrator. One or more of the configurations may be used in combination with the flux concentrator.

Figure 21:
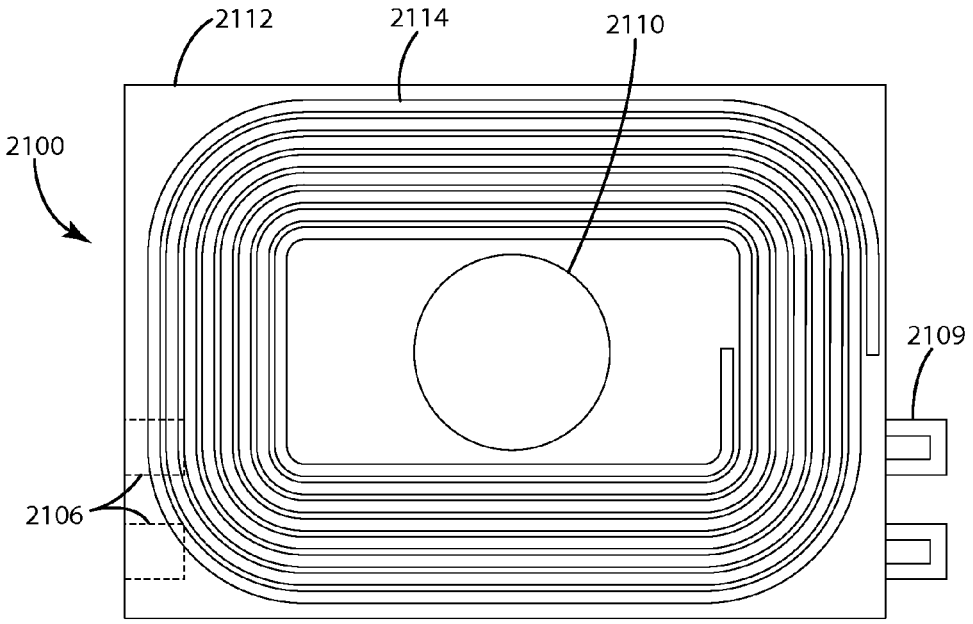
FIG. 21 shows a top view of one embodiment of a wireless power module.
Figure 22:
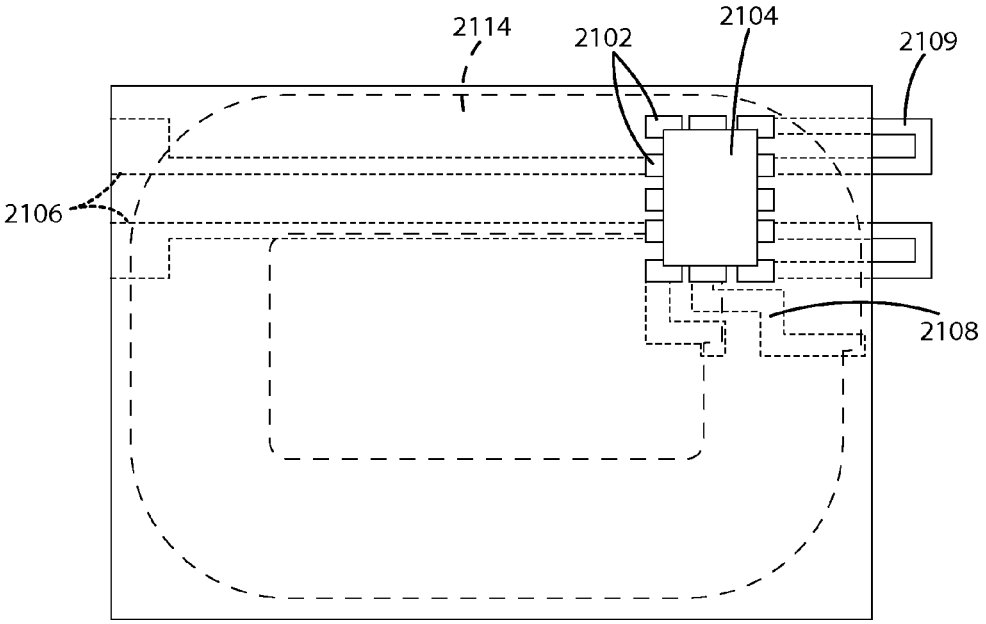
FIG. 22 shows a bottom view of the wireless power module of FIG. 21.

FIGS. 21 and 22 illustrate one embodiment of a wireless power module 2100. The wireless power module of the current embodiment generally includes a coil 2114, a flux concentrator 2112, wireless power semiconductor and support components 2104, pads 2102 for connection between the components and the module, and pads 2106 for external connection. Embedded traces 2108 may be used to electrically connect the coil, pads 2102, and pads 2106. The configuration of the embedded traces varies depending on the design and function of the wireless power module. In one embodiment, traces interconnect the leads of the coil and pads 2002 which are connected to a microcontroller. Embedded traces also connect pads 2002 to the externally located pads 2106. The wireless power module may also include configuration loops 2109, and an alignment element 2110. In the current embodiment the coil 2114 may be either stamped, a printed circuit board configuration, or a wire wound coil. The coil may be flush with the magnetic flux concentrator as shown in FIG. 4, or surface mounted as shown in FIG. 18A-D.

The wireless power module provides a simple package for manufacturers to integrate wireless power into a product. The wireless power module includes all of the components and circuitry necessary to either transmit or receive wireless power.

In the current embodiment, the wireless power semiconductor and support components 2104 includes a rectifier and microcontroller. The rectifier converts the AC power received from the coil into DC. The microcontroller can perform a variety of different functions. For example, the microcontroller may be capable of communicating with an inductive power supply, or regulating the amount of power provided by the wireless power module.

The configuration loops 2109 may be utilized to manually change the characteristics of the coil in the wireless power module. In one configuration, each configuration loop includes a high conductive path, and by breaking the loop, additional resistance may be added to the circuit. This technique is discussed in more detail in application No. 61/322,056 entitled Product Monitoring Devices, Systems, and Methods application.

The alignment element 2110 in the current configuration is a magnet. In alternative embodiments, a different alignment element may be used or eliminated altogether. The magnet cooperates with a magnet associated with the primary coil in order to line up the coils and provide efficient power transfer.

The wireless power module 2100 can be manufactured by placing any components to be embedded in the flux concentrator in a mold cavity and compression molding the flux concentrator so as to embed those components. In the embodiment shown in FIGS. 21-22, the coil 2114, magnet 2110, traces, 2108, configuration loops 2109, pads 2102, and pads 2106 are all embedded into the flux concentrator. The wireless power semiconductor and support components 2104 are connected to the pads 2102 after the flux concentrator is formed. In some embodiments, the flux concentrator may include a depression so that when the wireless power semiconductor and support components 2104 are connected they do not increase the height of the wireless power module.

Figure 23:
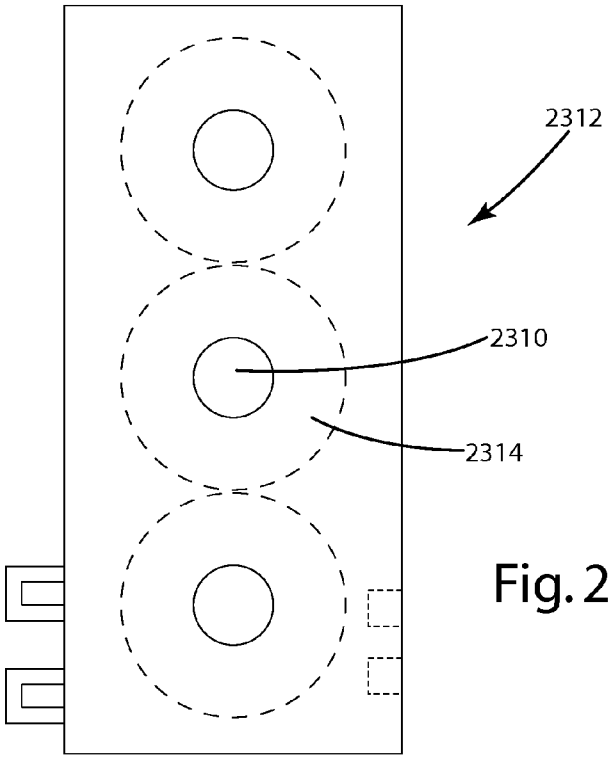
FIG. 23 shows a top view of an embodiment of a wireless power module with an array of coils.

FIG. 23 illustrates an alternative embodiment of a wireless power module. This embodiment is similar to the wireless power module described in connection with FIGS. 21-22, except that instead of a single coil, three exposed coils 2314 are included in the wireless power module 2312. Each coil may include an alignment element 2310. In FIG. 23, each of the coils 2314 is embedded flush with one surface of the flux concentrator providing an exposed surface for transferring power. In alternative embodiments, the coils may be embedded flush with different surfaces. Just as illustrated in FIG. 22, connections throughout the wireless power module may be made using traces embedded in the wireless power module. For example, the traces can provide an electrical connection between the coils and the wireless power semiconductor and support components.

Figure 24:
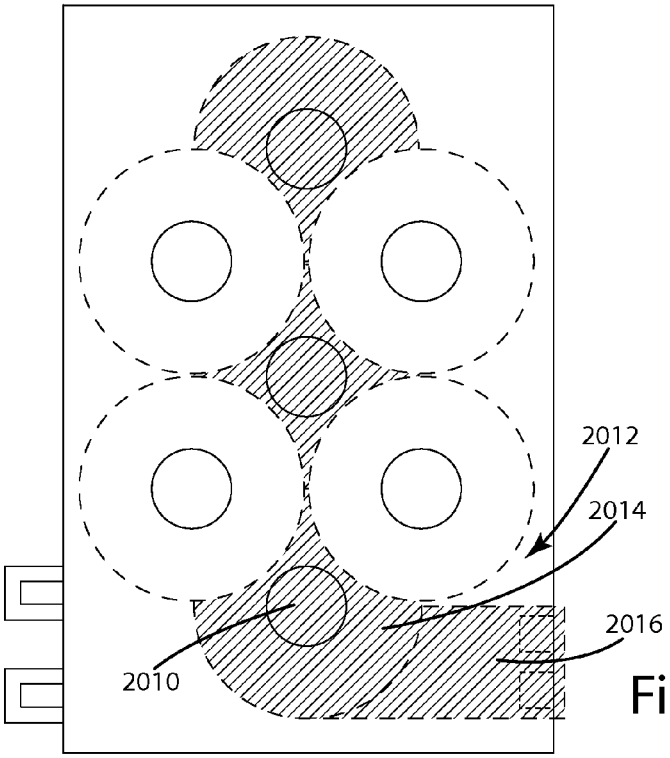
FIG. 24 shows a top view of another embodiment of a wireless power module with a multi-layer array of coils.

FIG. 24 illustrates an alternative embodiment of a wireless power module shown in FIG. 23. In this embodiment instead of a single layer array of coils, a multi-layer coil array assembly 2012 is embedded into the flux concentrator. The multi-layer coil array assembly 2012 includes a plurality of coils 2014 positioned in a multi-layer array, and a PCB or other non-conductive material 2016 between one or more of the coils and the surface of the flux concentrator. In some embodiments, alignment elements 2010 may be included A multi-layer coil array assembly 2012 for embedding in a flux concentrator can be created by positioning coils 2014 in a desired pattern and securing them in place. PCB or other non-conductive material 2016 may be utilized to protect the flux concentrator from covering the mixture during molding. During manufacture, the entire multi-layer coil array assembly 2012 can be placed in the mold cavity, soft magnetic powder mixture can be poured on the multi-layer coil array and be compression molded in order to embed the entire array in the flux concentrator. When the flux concentrator is ejected from the mold, some of the coils in the multi-layer coil array are exposed, and flush with a flux concentrator surface, other coils are embedded deeper in the flux concentrator and are not flush with the flux concentrator surface. However, a substantial portion of the coils that are embedded deeper in the flux concentrator are covered either by a coil that is flush with the flux concentrator surface or by the PCB or other non-conductive material 2016 that is part of the multi-layer coil array assembly. In some embodiments, such as the one shown in FIG. 24, the multi-layer coil array assembly can provide wire routing from each of the coils. In this way, when embedded in the flux concentrator, the wires may be routed to the edge of the flux concentrator by way of the multi-layer coil array assembly. From there, the wires can be connected either by embedded traces or by external connections to various wireless power semiconductor and support components located on the wireless power module.

Although the coil arrays of FIGS. 23 and 24 are described in the context of wireless power modules that have integrated wireless power semiconductor and support components, in alternative non-wireless power module embodiments, these coil configurations could be utilized as flux concentrators with embedded coil arrays. For example, the embedded, flush coil illustrated in FIG. 4 could be replaced with a single layer coil array or a multi-layer coil array assembly as described in connection with FIGS. 23 and 24.

Figure 25:
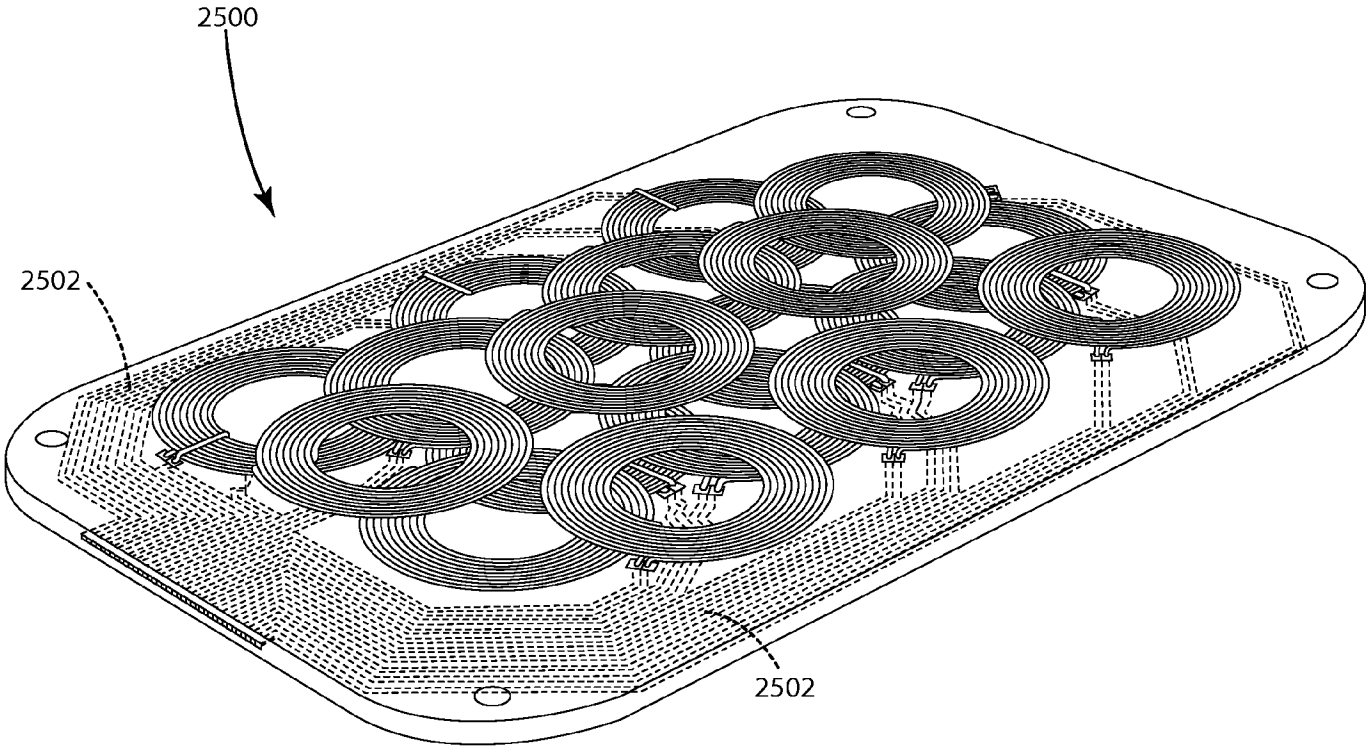
FIG. 25 shows a perspective view of an embodiment of a flux concentrator with co-molded traces.

FIG. 25 illustrates an embodiment of a flux concentrator 2500 with co-molded traces 2502. In the current embodiment, termination points on the traces protrude above the surface of the magnetic flux concentrator. The termination points can be crimp connections, solder pads, or any other suitable termination structure. The coils can be aligned in the coil array by placing them and attaching them to the appropriate termination points protruding from the flux concentrator. In alternative embodiments, a coil array assembly, similar to the one described above in connection with FIG. 24, and the embedded traces could be co-molded with the flux concentrator. The coils from the coil array assembly can be connected to the embedded traces in the flux concentrator for routing to the wireless power semiconductor and support components.

In embodiments including a multi-layer coil array, the coils and leads from the multi-layer coil array can be aligned and routed utilizing one of the multi-layer shim assemblies described in U.S. Provisional Patent Appl. No. 61/376,909, entitled Wireless Power Supply System and Multi-layer Shim Assembly, filed on Aug. 25, 2010, which is herein incorporated by reference.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A permanently laminated flux concentrator assembly comprising:

a flux concentrator having a thickness, a top surface, and a bottom surface; and a coil embedded in said flux concentrator, wherein one side of said coil is flush with said top surface of said flux concentrator forming an exposed side and another side of said coil is embedded within said thickness of said flux concentrator forming an unexposed side, wherein said coil is capable of inductive coupling on said exposed side and is incapable of inductive coupling on said unexposed side;

wherein said flux concentrator includes scoring to influence where said flux concentrator breaks in response to flexing; and a laminate adhesively and permanently secured to said flux concentrator forming a permanent bond between said laminate and said flux concentrator, wherein said laminate and said permanent bond hold together pieces of said flux concentrator that are broken at or near at least a portion of said scoring in response to flexing, wherein breaking said laminated flux concentrator does not significantly affect the magnetic properties of said laminated flux concentrator.

2. The permanently laminated flux concentrator assembly of claim 1 wherein said coil is selected from said group comprising a primary coil for transferring wireless power and a secondary coil for receiving wireless power.

3. The permanently laminated flux concentrator assembly of claim 1 wherein said flux concentrator concentrates electromagnetic field to increase inductive coupling.

4. The permanently laminated flux concentrator assembly of claim 1 wherein said coil is at least one of a stamped coil and a wire coil.

5. The permanently laminated flux concentrator assembly of claim 1 further including a magnet or magnetic attractor capable of providing sufficient magnetic attraction for alignment of a remote device with a wireless power transfer system.

6. The permanently laminated flux concentrator assembly of claim 5 wherein said magnet or magnetic attractor is either exposed on said flux concentrator surface or embedded below said surface of said flux concentrator.

7. The permanently laminated flux concentrator assembly of claim 1 further including a permanent magnet, wherein said flux concentrator assembly includes an insulator between said magnet and said flux concentrator for minimizing effects of AC field saturation caused by said permanent magnet.

8. The permanently laminated flux concentrator assembly of claim 1 further including a layer of strengthening material laminated on said top surface of said flux concentrator.

9. The permanently laminated flux concentrated assembly of claim 1 wherein said flux concentrator is configured to shield components disposed proximal to said unexposed side and behind said flexible flux concentrator relative to an external electromagnetic field source, wherein in an unbroken state, said flexible flux concentrator forms a single-piece shield having score lines and a permanently affixed laminate.

10. A flexible flux concentrator assembly comprising:

a flux concentrator having a thickness and a surface;

wherein said flux concentrator includes scoring to influence where said flux concentrator breaks in response to flexing;

a laminate adhesively and permanently secured to at least a portion of said surface of said flux concentrator forming a permanent bond between said laminate and said at least a portion of said surface of said flux concentrator;

wherein in response to bending said flexible flux concentrator 1) said flux concentrator is capable of being broken into a plurality of pieces with air gaps therebetween, wherein, in response to breaking said flexible flux concentrator at or near at least a portion of said scoring, said laminate and said permanent bond hold said plurality of pieces together such that said air gaps do not significantly affect the magnetic properties of said flux concentrator; and 2) said laminate remains permanently and adhesively secured to said at least said portion of said surface of said flux concentrator.

11. The flexible flux concentrator of claim 10 wherein said laminate surrounds said flux concentrator.

12. The flexible flux concentrator of claim 10 wherein said flux concentrator is scored to influence where said flux concentrator breaks in response to bending.

13. The flexible flux concentrator assembly of claim 10 including:

a coil embedded in said flux concentrator, wherein one side of said coil is flush with said surface of said flux concentrator forming an exposed side and another side of said coil is embedded within said thickness of said flux concentrator forming an unexposed side, wherein said coil is capable of inductive coupling on said exposed side and is incapable of inductive coupling on said unexposed side.

14. The flexible flux concentrator assembly of claim 10 further including a magnet or magnetic attractor capable of providing sufficient magnetic attraction for alignment of a remote device with a wireless power transfer system.

15. The flexible flux concentrator of claim 10 wherein said flux concentrator is molded into a shape with a width dimension, a thickness dimension, and a height dimension;

at least one of said height dimension and said width dimension is 25 times or greater than said thickness dimension; and wherein said flux concentrator has a saturation 500 mT or greater.

16. The flexible flux concentrator of claim 15, said flux concentrator having permeability greater than 15 times permeability of free space.

17. The flexible flux concentrator of claim 15, said flux concentrator having conductivity of 1 S/m or less.

18. The flexible flux concentrator of claim 15, said thickness dimension is 1 mm or less.

19. The flexible concentrator assembly of claim 13 wherein said flexible flux concentrator is configured to shield components disposed proximal to said unexposed side and behind said flexible flux concentrator relative to an external electromagnetic field source, wherein in an unbroken state, said flexible flux concentrator forms a single-piece shield having score lines and a permanently affixed laminate.

* * * * *